US010496000B2

(12) United States Patent
Hitaka

(10) Patent No.: US 10,496,000 B2
(45) Date of Patent: Dec. 3, 2019

(54) IMAGE FORMING APPARATUS, IMAGE FORMING METHOD AND NON-TRANSITORY COMPUTER-READABLE RECORDING MEDIUM ENCODED WITH IMAGE FORMING PROGRAM

(71) Applicant: Konica Minolta, Inc., Chiyoda-ku, Tokyo (JP)

(72) Inventor: Masatoshi Hitaka, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 296 days.

(21) Appl. No.: 15/730,271

(22) Filed: Oct. 11, 2017

(65) Prior Publication Data

US 2018/0143560 A1 May 24, 2018

(30) Foreign Application Priority Data

Nov. 22, 2016 (JP) ..... 2016-227044

(51) Int. Cl.
*G03G 15/02* (2006.01)
*G03G 15/08* (2006.01)
*G03G 21/14* (2006.01)

(52) U.S. Cl.
CPC ..... *G03G 15/02* (2013.01); *G03G 15/0806* (2013.01); *G03G 15/0887* (2013.01); *G03G 21/14* (2013.01)

(58) Field of Classification Search
CPC ..... G03G 15/02; G03G 15/0806; G03G 15/0887; G03G 21/14
See application file for complete search history.

(56) References Cited

U.S. PATENT DOCUMENTS 6,697,601 B1 * 2/2004 Kamimura ..... G03G 15/6502 399/388
9,217,978 B2 * 12/2015 Ikeda ..... G03G 15/6564
(Continued)

FOREIGN PATENT DOCUMENTS

CN 1420397 5/2003
JP 2000-238921 A 9/2000
(Continued)

OTHER PUBLICATIONS

First Office Action issued in corresponding Chinese Patent Applicatimi No. 2017111410624, dated Feb. 2, 2019, with English Translation (12 pages).

*Primary Examiner* — David H Banh
(74) *Attorney, Agent, or Firm* — Buchanan Ingersoll & Rooney PC

(57) ABSTRACT

An image forming apparatus includes an image forming controller forming a toner image on an image carrying member, and transferring at a transfer position the toner image formed on the image carrying member onto a sheet being conveyed on a conveyance path, and a hardware-processor. The hardware-processor determines an image position indicating a position for an image to be formed on the sheet, determines a grace period based on the image position, stops the sheet at a waiting position on an upstream side from the transfer position, restarts paper conveyance at a second point when a predetermined period elapses from a first point of starting formation of the toner image on the image carrying member, and conveys the sheet to the transfer position if paper conveyance can be restarted before the grace period elapses from the second point though paper conveyance cannot be restarted at the second point.

19 Claims, 15 Drawing Sheets

(56) References Cited

U.S. PATENT DOCUMENTS

| | | | | |
|---|---|---|---|---|
| 2001/0022660 | A1* | 9/2001 | Toyofuku | B41C 1/1083<br>358/1.6 |
| 2004/0131407 | A1* | 7/2004 | Sato | G03G 15/6564<br>399/394 |

FOREIGN PATENT DOCUMENTS

| | | | |
|---|---|---|---|
| JP | 2003-167485 | A | 6/2003 |
| JP | 2006-282289 | A | 10/2006 |
| JP | 2015-184651 | A | 10/2015 |
| JP | 2016-65962 | A | 4/2016 |

* cited by examiner

FIG. 9

| PATH | | | DISTANCE (mm) | PERIOD (ms) |
|---|---|---|---|---|
| TYPE | START POSITION | END POSITION | | |
| TONER IMAGE | EXPOSURE START POSITION | TRANSFER POSITION X | 300 | 1000 |
| PAPER PATH 1 | TIMING ROLLER | TRANSFER POSITION X | 100 | 333 |
| PAPER PATH 2 | TIMING SENSOR | TIMING ROLLER | 50 | 100 |
| PAPER PATH 3 | PAPER FEED CASSETTE | TIMING SENSOR | 130 | 270～300 |

TONER CONVEYANCE SPEED S＝300mm/s
PAPER CONVEYANCE SPEED SS＝500mm/s

FIG. 10

| INTERVAL | PERIOD (ms) |
|---|---|
| INTERVAL OF EXPOSURE START TIME | 850 |
| SECOND STOP PERIOD | 50 |
| PAPER INTERVAL (ALLOWABLE MINIMUM VALUE) | 20 |

FIG. 11

| EVENT FOR PAPER | PERIOD ELAPSED FROM EXPOSURE START TIME (ms) |
|---|---|
| START PAPER CONVEYANCE | 217 |
| ARRIVAL AT TIMING SENSOR | 487～517 |
| ARRIVAL AT TIMING ROLLER | 587～617 |
| STOP AT PAPER FEED ROLLER | 597～627 |
| RESTART FROM TIMING ROLLER | 667 |
| TRANSFER POSITION X | 1000 |
| PASS THROUGH TIMING SENSOR | 1200 |
| PASS THROUGH TIMING ROLLER | 1367 |

| AREA NUMBER | TONER OCCUPANCY RATIO | MAXIMUM DENSITY(0～255) | | | |
|---|---|---|---|---|---|
| | | Y | M | C | K |
| 1 | 0% | 0 | 0 | 5 | 0 |
| 2 | 5% | 0 | 0 | 5 | 10 |
| 3 | 15% | 0 | 0 | 5 | 200 |
| 4 | 25% | 0 | 0 | 5 | 200 |
| 5 | 25% | 0 | 0 | 5 | 200 |
| 6 | 25% | 0 | 0 | 5 | 200 |
| 7 | 25% | 0 | 0 | 5 | 200 |
| 8 | 25% | 0 | 0 | 5 | 200 |
| 9 | 10% | 0 | 0 | 5 | 200 |
| 10 | 5% | 0 | 0 | 5 | 10 |
| 11 | 0% | 0 | 0 | 0 | 0 |

IMAGE FORMING APPARATUS, IMAGE FORMING METHOD AND NON-TRANSITORY COMPUTER-READABLE RECORDING MEDIUM ENCODED WITH IMAGE FORMING PROGRAM

Japanese Patent Application No. 2016-227044 filed on Nov. 22, 2016, including description, claims, drawings, and abstract, the entire disclosure is incorporated herein by reference in its entirety.

BACKGROUND

Technological Field

The present invention relates to an image forming apparatus, an image forming method, and an image forming program. More specifically, the present invention relates to an image forming apparatus which forms an image on a sheet by using toner, an image forming method executed by the image forming apparatus, and a non-transitory computer-readable recording medium encoded with an image forming program which is executed by the image forming apparatus.

Description of the Related Art

In these years, an image forming apparatus represented by a multi-function peripheral (hereinafter, referred to as an "MFP") includes a photoreceptor drum and a developing device which develops with toner an electrostatic latent image formed on the photoreceptor drum, and forms an image on a sheet by transferring a toner image formed on the photoreceptor drum onto the sheet. In the image forming apparatus of this kind, in order to transfer the toner image onto a predetermined position of the sheet, a timing when the sheet is conveyed is synchronized with a timing when the toner image is formed on the photoreceptor drum.

Meanwhile, Japanese Patent Laid-Open No. 2003-167485 describes an image forming apparatus which includes an image forming portion that performs an image formation by retransferring an image formed on an intermediate transfer body onto a delivered sheet medium, the image forming apparatus including: a sheet medium storing portion which stores the sheet medium; a sheet medium delivery portion which delivers the sheet medium to a predetermined retransfer position where the image formed on the intermediate transfer body is retransferred onto the sheet medium; a monitoring portion which monitors a transfer state of the sheet medium by the sheet medium delivery portion; a determining portion which determines whether it is delayed behind a retransfer timing when the image formed on the intermediate transfer body is retransferred, based on the transfer state of the sheet medium monitored by the monitoring portion; and in the case where the determining portion determines that it is delayed behind the retransfer timing, a recovery processing portion which performs, according to a factor of the delay, a predetermined delay recovery processing with respect to a sheet medium to be delivered from the sheet medium delivery portion so as to recover a delivery state where the image on the intermediate transfer body can be retransferred on the sheet medium.

However, according to the image forming apparatus described in Japanese Patent Laid-Open No. 2003-167485, it is impossible to recover from the delay for a delayed sheet at a point of time when a delay behind the retransfer timing is detected. Therefore, it is necessary to newly form the same image after toner formed on the intermediate transfer body is discarded, and thus there is a problem that toner is wastefully consumed and long time is required for image formation.

SUMMARY

According to an aspect of the present invention, an image forming apparatus includes: a conveyance controller that conveys a sheet along a conveyance path; an image forming controller that forms a toner image on an image carrying member, and transfers the toner image formed on the image carrying member onto a sheet being conveyed on the conveyance path at a transfer position in the conveyance path; and a hardware-processor. The hardware-processor determines an image position indicating a position in a sheet for an image scheduled to be formed on the sheet, determines a grace period based on the image position, stops the sheet at a waiting position on an upstream side of the transfer position, restarts conveyance of the sheet at a second point of time when a predetermined time period elapses from a first point of time when formation of the toner image on the image carrying member is started, and conveys the sheet to the transfer position if conveyance of the sheet can be restarted before the determined grace period elapses from the second point of time even when conveyance of the sheet cannot be restarted at the second point of time.

According to another aspect of the present invention, an image forming method is performed by an image forming apparatus capable of forming a toner image on an image carrying member, and transferring the toner image formed on the image carrying member onto a sheet being conveyed on a conveyance path at a transfer position in the conveyance path. The image forming method includes: an image position determining step of determining an image position indicating a position in a sheet for an image scheduled to be formed on the sheet; a grace period determining step of determining a grace period based on the image position; and a conveyance control step of stopping the sheet at a waiting position on an upstream side of the transfer position, and restarting conveyance of the sheet at a second point of time when a predetermined time period elapses from a first point of time when formation of the toner image on the image carrying member is started. The conveyance control step includes a step of conveying the sheet to the transfer position if conveyance of the sheet can be restarted before the determined grace period elapses from the second point of time even when conveyance of the sheet cannot be restarted at the second point of time.

According to a further aspect of the present invention, a non-transitory computer-readable recording medium is encoded with an image forming program performed by a computer which controls an image forming apparatus capable of forming a toner image on an image carrying member, and transferring the toner image formed on the image carrying member onto a sheet being conveyed on a conveyance path at a transfer position in the conveyance path. The image forming program causes the computer to perform: determining an image position indicating a position in a sheet for an image scheduled to be formed on the sheet; determining a grace period based on the image position; stopping the sheet at a waiting position on an upstream side of the transfer position; restarting conveyance of the sheet at a second point of time when a predetermined time period elapses from a first point of time when formation of the toner image on the image carrying member is started; and conveying the sheet to the transfer position if conveyance of the sheet can be restarted before the determined grace period elapses from the second point of time even when conveyance of the sheet cannot be restarted at the second point of time.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 9 is a diagram showing an example of a distance and a conveyance period for every path according to the embodiments;

FIG. 10 is a diagram showing a value of a predetermined interval according to the embodiments;

FIG. 11 is a diagram showing an elapsed period from an exposure start time for every event for a sheet;

DESCRIPTION OF THE PREFERRED EMBODIMENTS

Figure 1:
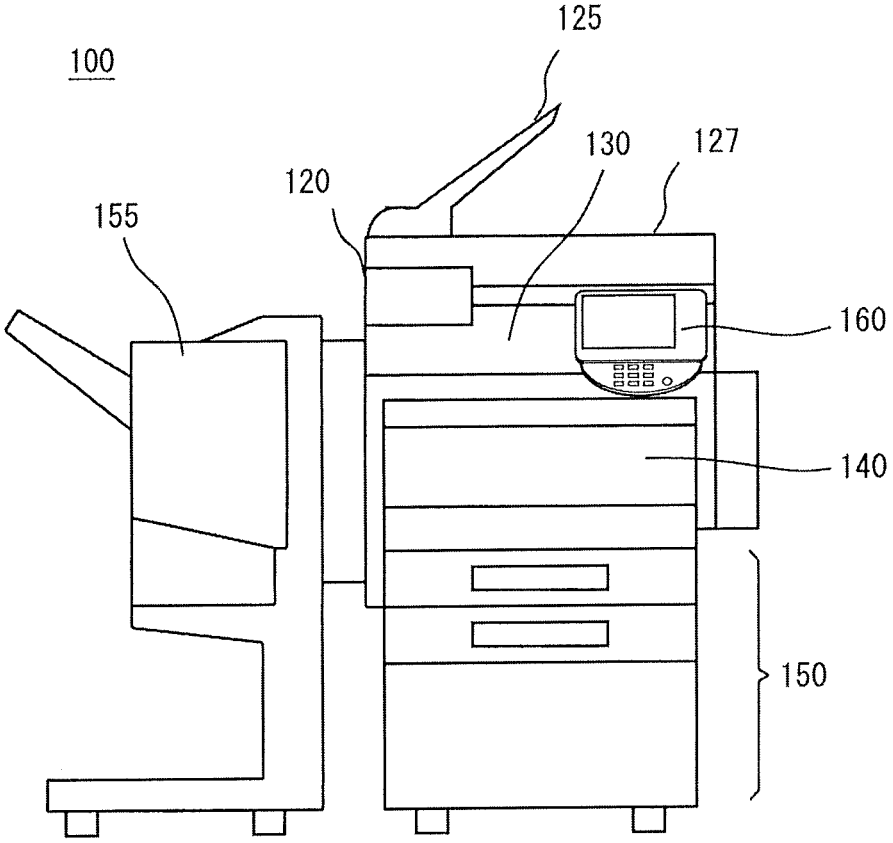
FIG. 1 is a perspective view showing an external appearance of an MFP according to one of embodiments of the present invention.

Hereinafter, one or more embodiments of the present invention will be described with reference to the drawings. However, the scope of the invention is not limited to the disclosed embodiments.

Hereinafter, one or more embodiments of the present invention will be described with reference to the drawings. In the following description, the same or corresponding parts are denoted by the same reference characters. Their names and functions are also the same. Thus, a detailed description thereof will not be repeated.

Figure 2:
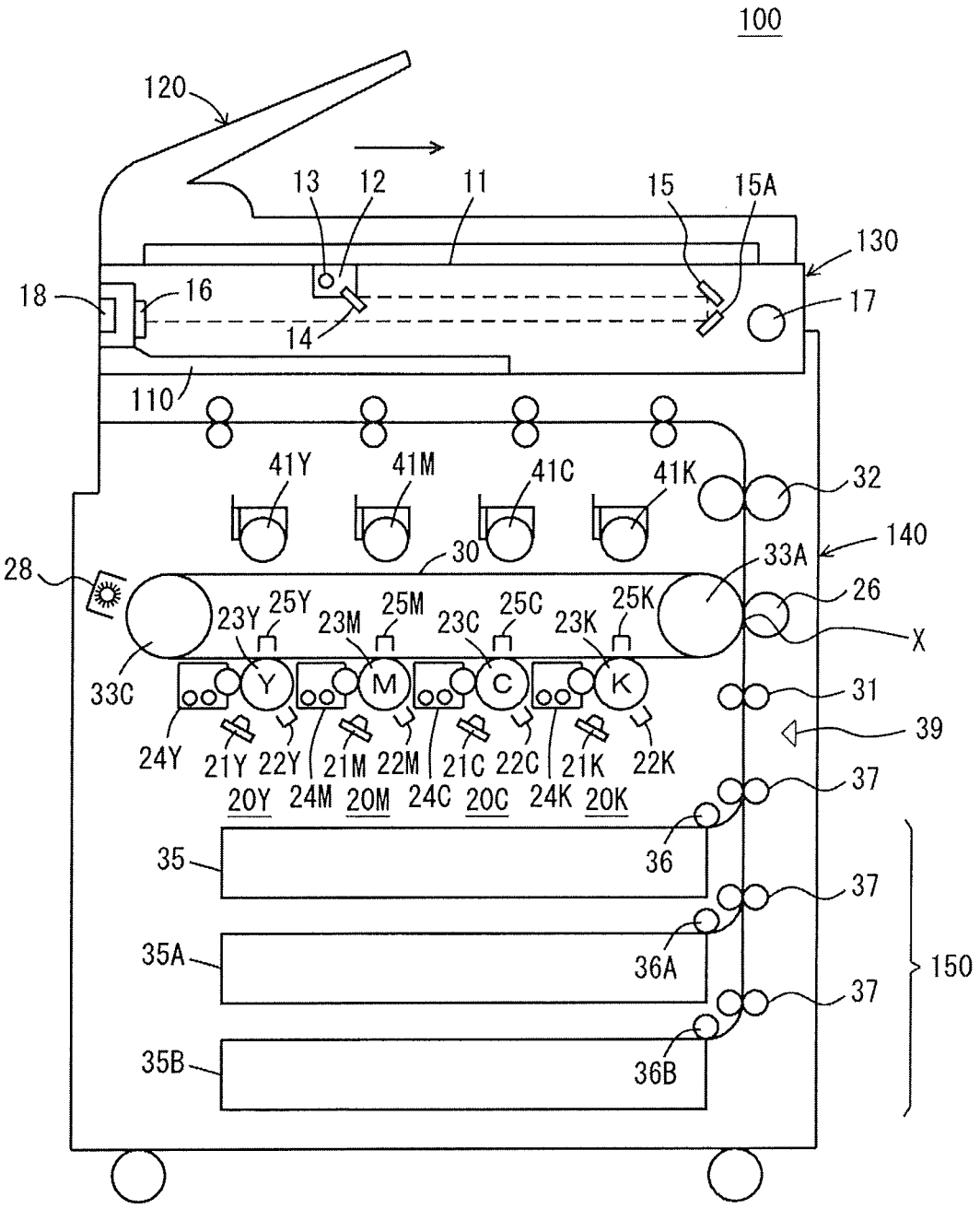
FIG. 2 is a cross-section view schematically showing an internal configuration of the MFP.

FIG. 1 is a perspective view showing an external appearance of an MFP according to one of embodiments of the present invention. FIG. 2 is a cross-section view schematically showing an internal configuration of the MFP. Referring to FIGS. 1 and 2, an MFP 100 includes: a document scanning unit 130 for scanning a document; an automatic document feeder 120 for conveying a document to the document scanning unit 130; an image forming unit 140 for forming on a sheet and the like a still image output by the document scanning unit 130 scanning a document; a paper feed unit 150 for supplying sheets to the image forming unit 140; a post processing unit 155; and an operation panel 160 serving as a user interface.

The automatic document feeder 120 separates each of one or more documents placed on a document tray 125, and conveys one by one to the document scanning unit 130. The document scanning unit 130 exposes an image of a document, which has been conveyed onto a platen glass 11 by the automatic document feeder 120, to an exposure lamp 13 attached to a slider 12 moving beneath the platen glass 11. A reflection light from the document is led by a mirror 14 and two reflection mirrors 15 and 15A to a projection lens 16, and is imaged on a CCD (Charge Coupled Device) sensor 18. The exposure lamp 13 and the mirror 14 are attached to the slider 12, and the slider 12 is moved by a scanner motor 17 in the direction of arrow as shown in the figure (in a sub scanning direction) at the speed V in accordance with a copy magnification rate. This allows scanning the entire surface of the document placed on the platen glass 11. Further, according to movement of the exposure lamp 13 and the mirror 14, two reflection mirrors 15 and 15A move in the direction of arrow as shown in the figure at the speed V/2. Consequently, an optical path length of the light emitted to the document by the exposure lamp 13 remains constant after reflecting from the document until being imaged on the CCD sensor 18.

The reflection light, which has been imaged on the CCD sensor 18, is converted into image data as an electrical signal within the CCD sensor 18, and is transmitted to a main circuit which is not shown in the figure. The main circuit performs an A/D conversion processing, a digital image processing and the like on the received analog image data, so as to output to the image forming unit 140. The main circuit converts the image data into print data in cyan (C), magenta (M), yellow (Y) and black (K), so as to output to the image forming unit 140.

The image forming unit 140 includes developing devices 24Y, 24M, 24C and 24K, and their corresponding tonner bottles 41Y, 41M, 41C and 41K each being attachable to and detachable from the developing devices 24Y, 24M, 24C and 24K, respectively. Each of the tonner bottles 41Y, 41M, 41C and 41K stores toner of yellow, magenta, cyan and black, respectively. Here, "Y", "M", "C" and "K" respectively indicates yellow, magenta, cyan and black. Toners stored in the toner bottles 41Y, 41M, 41C and 41K are respectively supplied to each of the developing devices 24Y, 24M, 24C and 24K.

The image forming unit 140 includes image forming units 20Y, 20M, 20C and 20K, each of which is for yellow, magenta, cyan and black. When at least one of the image forming units 20Y, 20M, 20C and 20K is driven, an image is formed. All of the image forming units 20Y, 20M, 20C and 20K are driven, a full color image is formed. The print data each in yellow, magenta, cyan and black is input to each of the image forming units 20Y, 20M, 20C and 20K. The image forming units 20Y, 20M, 20C and 20K are the same except for color of toner. Therefore, the image forming unit 20Y for forming an image in yellow will be described as an example hereinafter.

The image forming unit 20Y includes: an exposure head 21Y to which the print data in yellow is input; a photoreceptor drum (an image carrying member) 23Y; an electrostatic charger 22Y; the developing device 24Y; and a transfer charger 25Y. The exposure head 21Y emits a laser light in response to reception of the print data (electrical signal). The emitted laser light is one-dimensionally scanned by a polygon mirror included in the exposure head 21Y, so as to cause the photoreceptor drum 23Y to be exposed. The direction of one-dimensional scanning of the photoreceptor drum is a main scanning direction.

The photoreceptor drum 23Y, after being charged by the electrostatic charger 22Y, is irradiated with the laser light emitted by the exposure head 21Y. Thus, an electrostatic latent image is formed on the photoreceptor drum 23Y. Next, the developing device 24Y puts toner on the electrostatic latent image so that a toner image is formed. The toner image formed on the photoreceptor drum 23Y is transferred onto an intermediate transfer belt 30 by the transfer charger 25Y.

Meanwhile, the intermediate transfer belt 30 is suspended between a driving roller 33C and a roller 33A so as not to be loosened. When the driving roller 33C rotates counterclockwise as shown in the figure, the intermediate transfer belt 30 rotates counterclockwise as shown in the figure at a predetermined speed. In accordance with rotation of the intermediate transfer belt 30, the roller 33A rotates counterclockwise.

Accordingly, each of the image forming units 20Y, 20M, 20C and 20K consecutively transfers the toner image onto the intermediate transfer belt 30. The timing when each of the image forming units 20Y, 20M, 20C and 20K transfers the toner image onto the intermediate transfer belt 30 is controlled by an event that a reference mark attached to the intermediate transfer belt 30 is detected. Then, toner images each in yellow, magenta, cyan and black respectively are superimposed on the intermediate transfer belt 30. Further, a rotating speed of the driving roller 33C is predetermined. Hereinafter, a speed of movement of the toner image formed on the intermediate transfer belt 30 is denoted as a toner conveyance speed S.

Sheets in different sizes are set in each of paper feed cassettes 35, 35A and 35B. The sheets stored in each of the paper feed cassettes 35, 35A and 35B are supplied to a conveyance path by ejecting rollers 36, 36A and 36B each of which is respectively attached to each of the paper feed cassettes 35, 35A and 35B, and are conveyed to a timing roller 31 by a paper feed roller 37. A speed of the sheet conveyed through the conveyance path by the paper feed roller 37 is predetermined, and hereinafter is denoted as a paper conveyance speed SS. The paper conveyance speed SS may be the same value as the toner conveyance speed S, but may be a different value.

The paper feed roller 37 stops, if necessary, the sheet within the conveyance path. Specifically, a timing sensor 39 for detecting the sheet is provided on an upstream side of the conveyance path of the timing roller 31. After a first stop period elapses from an event that the timing sensor 39 detects the sheet within the conveyance path, the paper feed roller 37 stops driving so as to stop the sheet within the conveyance path. At a stage where the paper feed roller 37 stops driving, a tip of the sheet comes into contact with the timing roller 31, and then the sheet is deflected. If a state where the sheet is pushed onto the timing roller 31 by the paper feed roller 37 so as to be deflected is maintained for a predetermined time period, a tip of the sheet is moved along the timing roller 31, and thus a direction of the sheet is adjusted. A predetermined period for adjusting the direction of the sheet is denoted as a second stop period.

In the case where a state where the sheet is pushed onto the timing roller 31 by the paper feed roller 37 so as to be stopped is maintained for equal to or more than the second stop period, the timing roller 31 becomes able to convey the sheet. The first stop period and the second stop period partially overlap with each other. After a stop period ST elapses after an event that the timing sensor 39 has detected the sheet within the conveyance path, the timing roller 31 becomes able to convey the sheet. The stop period ST is a value obtained by subtracting a time period during which the first stop period and the second stop period overlap with each other from the sum of the first stop period and the second stop period.

The timing roller 31 starts conveying the sheet in accordance with a timing when the toner image formed on the intermediate transfer belt 30 reaches a transfer position X. While the timing roller 31 is conveying the sheet, the paper feed roller 37 is idling. The sheet conveyed by the timing roller 31 is pushed onto the intermediate transfer belt 30 by a transfer roller 26 at the transfer position X, and accordingly, toner images each in yellow, magenta, cyan and black which have been formed in a superimposed manner on the intermediate transfer belt 30, are transferred onto the sheet. A cleaner 28 is arranged on an outer circumferential side of the driving roller 33C. The cleaner 28 removes toner remaining on the intermediate transfer belt 30.

The sheet on which the toner images have been transferred is conveyed to a fixing roller pair 32, and is heated by the fixing roller pair 32. This allows toner to be melted so as to be fixed to the sheet. After that, the sheet is conveyed to a post processing unit 155. Here, it will be described about the MFP 100 in tandem system which includes the image forming units 20Y, 20M, 20C and 20K each forming a toner image in different four colors on a sheet, however, there may be an MFP in 4 cycle system which includes one photoreceptor drum to consecutively transfer each of toner images in different four colors onto a sheet.

In the case of forming an image in full color, the MFP 100 drives all of the image forming units 20Y, 20M, 20C and 20K; whereas in the case of forming an image in monochrome, the MFP 100 drives any one of the image forming units 20Y, 20M, 20C and 20K. Further, the MFP 100 can form an image by combining two or more of the image forming units 20Y, 20M, 20C and 20K.

The image forming unit 20Y among the image forming units 20Y, 20M, 20C and 20K has the longest distance to the transfer position X. Hereinafter, a time period from when the exposure head 21Y starts scanning the photoreceptor drum 23Y until the toner image reaches the transfer position X is denoted as a toner conveyance period T1. In the case where the print data includes a blank part, the scanning of the photoreceptor drum 23Y by the exposure head 21Y includes scanning of the blank part. It should be noted that, in the scanning of the blank part, the exposure head 21Y does not emit laser light. A value obtained by multiplying the toner conveyance period T1 by the toner conveyance speed S is denoted as a toner conveyance distance L1.

When a distance from the timing roller 31 to the transfer position X is denoted as a paper conveyance distance L2, a value obtained by dividing the paper conveyance distance L2 by the toner conveyance speed S becomes denoted as a paper conveyance period T2 during which the timing roller 31 conveys the sheet to the transfer position X. Therefore, based on the paper conveyance period T2, it is possible to determine a timing when the timing roller 31 starts conveying the sheet. It should be noted that, it requires a predetermined time period from when the timing roller 31 starts driving in a stop state until the timing roller 31 reaches the toner conveyance speed S. Therefore, to be exact, the paper conveyance period T2 becomes longer than a value obtained by dividing the paper conveyance distance L2 by the toner conveyance speed S. An error occurred for the paper conveyance period T2 may become varied according to a performance by a driving motor which drives rotating of the timing roller 31. However, since the paper conveyance period T2 has a constant value, the paper conveyance period T2 may be a value obtained by an experiment.

A restart time (a second point of time) when the timing roller 31 starts conveying the sheet to the transfer position X is determined from the toner conveyance period T1 and the paper conveyance period T2, based on an exposure start time (a first point of time) when the exposure head 21Y starts scanning the photoreceptor drum 23Y. Specifically, the restart time is a point of time when an adjusting period T3 obtained by subtracting the paper conveyance period T2 from the toner conveyance period T1 elapses from the exposure start time (the first point of time).

Distances of the conveyance path to the timing sensor 39 from each of the paper feed cassettes 35, 35A and 35B are different from each other. It is here assumed that, a distance DL1 is from the paper feed cassette 35 to the timing sensor 39, a distance DL2 is from the paper feed cassette 35A to the timing sensor 39, and a distance DL3 is from the paper feed cassette 35B to the timing sensor 39. In this case, a preparing period DT1 which is required for conveying the sheet set in the paper feed cassette 35 to the timing sensor 39, theoretically, becomes a value obtained by dividing the distance DL1 by the paper conveyance speed SS. Likewise, a preparing period DT2 which is required for conveying the sheet set in the paper feed cassette 35A to the timing sensor 39 becomes a value obtained by dividing the distance DL2 by the paper conveyance speed SS, and a preparing period DT3 which is required for conveying the sheet set in the paper feed cassette 35B to the timing sensor 39 becomes a value obtained by dividing the distance DL3 by the paper conveyance speed SS. However, since a time period during which each of the ejecting rollers 36, 36A and 36B holds the sheet and a length of the sheet held by each of the ejecting rollers 36, 36A and 36B become varied according to a slippery state of paper and the like, it is difficult to determine each of the preparing periods DT1, DT2 and DT3 as constant. Therefore, each of the preparing periods DT1, DT2 and DT3 is determined based on a value obtained from an experiment, as a period having a range which can be allowed from view of configuration.

Based on a remaining period T5 obtained by subtracting the paper conveyance period T2 from the toner conveyance period T1, each of the preparing periods DT1, DT2 and DT3 should be equal to or less than a period obtained by subtracting the stop period ST from the remaining period T5. Therefore, for example, a paper conveyance start point of time of starting conveyance of the sheet from the paper feed cassette 35, at the latest, may be a point of time behind the exposure start time by a time period obtained by subtracting a maximum value of the preparing period DT1 and the stop period ST from the remaining period T5.

The post processing unit 155 processes one or more sheets on which an image has been formed by the image forming unit 140. The post processing unit 155 includes a sorting process of sorting one or more sheets for ejection, a hole punching process of punching the sheets, a stapling process of stapling sheets, a folding process of folding the sheets, and a cutting process of cutting a part of the sheets.

Figure 3:
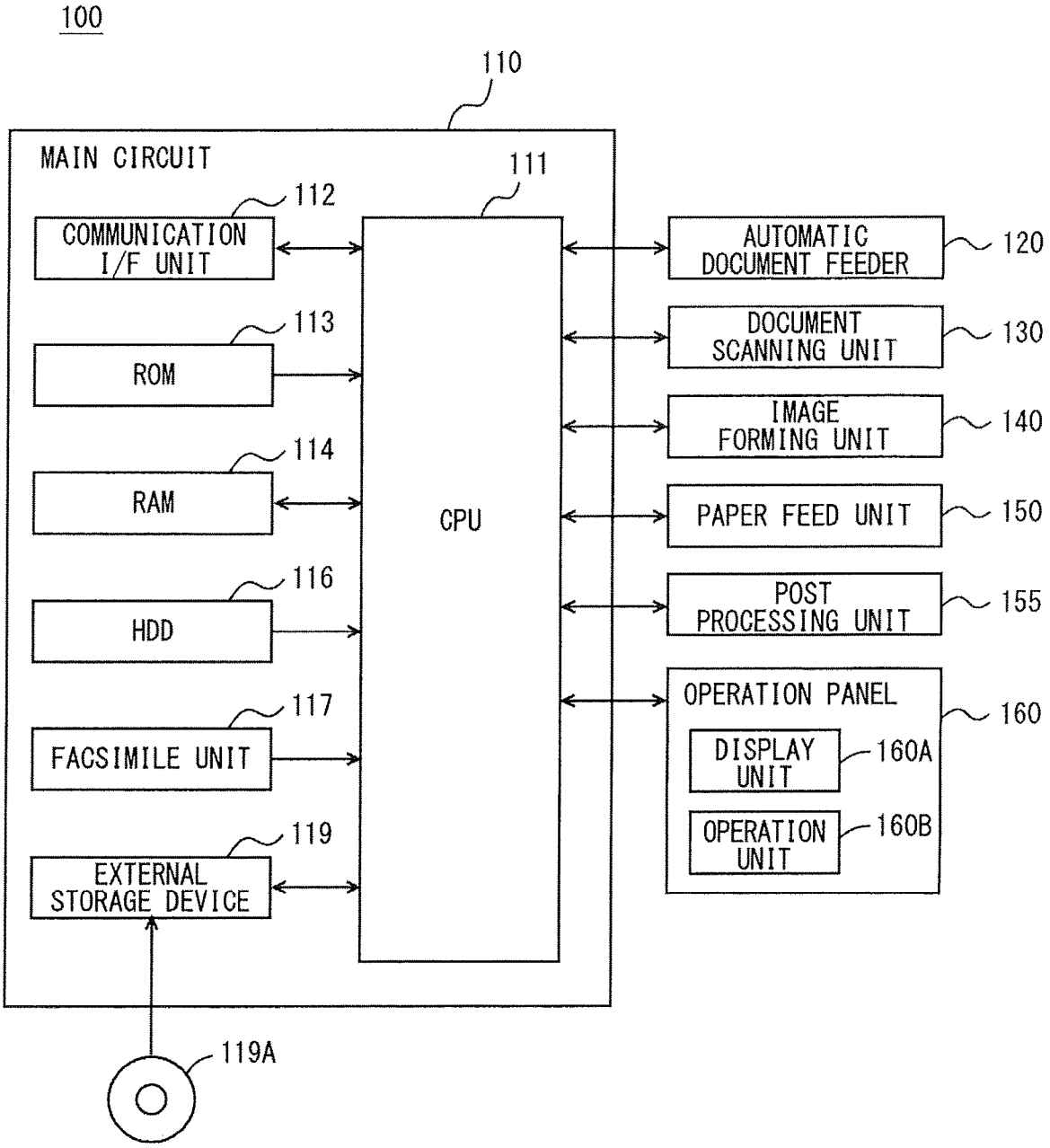
FIG. 3 is a block diagram showing an example of a hardware configuration of the MFP.

FIG. 3 is a block diagram showing an example of a hardware configuration of the MFP. Referring to FIG. 3, a main circuit 110 included in the MFP 100 includes: a CPU 111, a communication interface (I/F) unit 112; a ROM (Read Only Memory) 113; a RAM (Random Access Memory) 114; a hard disk drive (HDD) 116 as a mass storage; a facsimile unit 117; and an external storage device 119 on which a compact disk ROM (CD-ROM) 119A is mounted. Further, the CPU 111 is connected to each of the automatic document feeder 120, the document scanning unit 130, the image forming unit 140, the paper feed unit 150, the post processing unit 155 and the operation panel 160, and is responsible for overall control of the MFP 100.

The ROM 113 stores a program executed by the CPU 111 and data necessary for execution of the program. The RAM 114 is used as a work area for the CPU 111 to execute the program.

The operation panel 160 is arranged on an upper surface of the MFP 100 (as shown in FIG. 1), and includes a display unit 160A and an operation unit 160B. The display unit 160A is a display device such as Liquid Crystal Display (LCD) device or an organic ELD (Electroluminescence Display) device, for example, and displays instruction menus to users, information about acquired image data. The operation unit 160B includes a plurality of keys, and accepts input of data, such as instructions, characters, and numerical characters, according to the key operations by the user. The operation unit 160B further includes a touch panel disposed on the display unit 160A.

The communication I/F unit 112 is an interface for connecting the MFP 100 to a network. The CPU 111 communicates with another MFP and a personal computer (PC) for transmission/reception of data via the communication I/F unit 112. Further, the communication I/F unit 112 is capable of communicating with a computer which is connected to the Internet via a network.

The facsimile unit 117 is connected to the public switched telephone networks (PSTN) and transmits facsimile data to or receives facsimile data from the PSTN. The facsimile unit 117 stores the received facsimile data in the HDD 116, or outputs to the image forming unit 140. The image forming unit 140 prints on a sheet the facsimile data received from the facsimile unit 117. Further, the facsimile unit 117 converts the data stored in the HDD 116 into facsimile data so as to transmit to a facsimile device which is connected to the PSTN.

The CD-ROM 119A is mounted on the external storage device 119. The CPU 111 is accessible to the CD-ROM via the external storage device 119. The CPU 111 loads into the RAM 114 for execution a program stored in the CD-ROM 119A mounted on the external storage device 119. It should be noted that, a program executed by the CPU 111 is not limited to a program stored in the CD-ROM 119A, but a program stored in the HDD 116 may be loaded into the RAM 114 for execution. In this case, another computer connected to the network may overwrite the program stored in the HDD 116 of the MFP 100 or additionally write a new program therein. Alternatively, the MFP 100 may download a program from another computer connected to the network and store the program into the HDD 116. The program referred to here includes not only a program directly executable by the CPU 111 but also a source program, a compressed program, an encrypted program and the like.

It is noted that the medium for storing the program executed by the CPU 111 is not restricted to the CD-ROM 119A. It may be an optical disc (a magneto-optical (MO) disc/a mini disc (MD)/a digital versatile disc (DVD)), an IC card, an optical card, or a semiconductor memory such as a mask ROM, an erasable programmable ROM (EPROM), an electrically erasable and programmable ROM (EEPROM), or the like.

Figure 4:
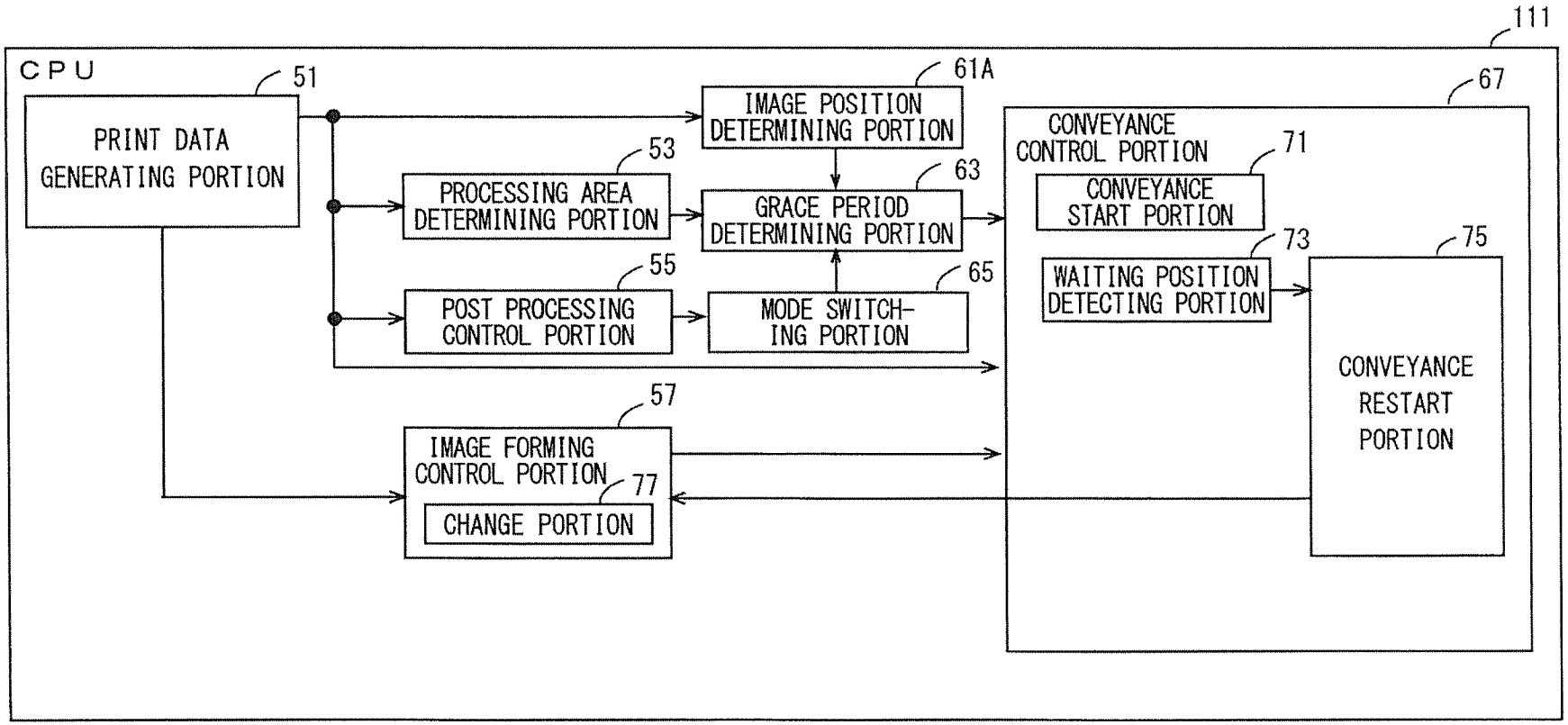
FIG. 4 is a block diagram showing an example of functions of a CPU included in the MFP.

FIG. 4 is a block diagram showing an example of functions of a CPU included in the MFP. The functions shown in FIG. 4 are functions formed in the CPU 111 as the CPU 111 included in the MFP 100 executes an image forming program stored in the ROM 113, the HDD 116, or the CD-ROM 119A. Referring to FIG. 4, the CPU 111 included in the MFP 100 includes: a print data generating portion 51; a processing area determining portion 53; a post processing control portion 55; an image forming control portion 57; an image position determining portion 61; a grace period determining portion 63; a mode switching portion 65; and a conveyance control portion 67.

The print data generating portion 51 executes a print job, and generates print data that the image forming unit 140 uses for forming an image. The print data generating portion 51, for example, in the case where the communication I/F 112 receives a print job from an external computer, executes the print job. The print job is described in, for example, Printer Job Language (PJL), and Printer Control Language (PCL), and includes a print condition and data targeted for image formation. Further, in the case where a user operates the operation unit 160B, the print data generating portion 51 generates the print data based on the data designated by the user and the print condition set by the user. The data designated by the user includes image data output by the document scanning unit 130 scanning a document, data stored in the HDD 116, and data stored in the external computer.

The print condition includes: an image formation condition for the image forming unit 140 to form an image; a paper conveyance condition for the paper feed unit 150 to convey the sheet; and a post processing condition for the post processing unit 155 to execute the post process. For example, the image formation condition includes: information regarding a blank area of the sheet, in which an image is not formed; and a setting value for defining a monochrome/color printing and the like. The paper conveyance condition includes: size and direction of the sheet in which an image is formed; and a setting value for defining a paper feed tray. The post processing condition includes: existence/absence of execution of the post process such as a sorting process, a hole punching process, a stapling process, a folding process, and a cutting process; and a setting value for executing each of the post processes.

The print data may be, for example, data in the form of bitmap. The print data corresponds to a size of the sheet targeted for image formation, and determines by a plurality of pixel values an image scheduled to be formed on the sheet. The print data includes four pieces of data, each of which corresponds respectively to yellow, magenta, cyan and black. Therefore, in the case where the image formation includes a plurality of pages, the print data includes four pieces of data, each of which corresponds respectively to yellow, magenta, cyan and black, for each page of the plurality of pages.

The print data generating portion 51 outputs the print data to the image forming control portion 57, and outputs the print condition respectively to the image position determining portion 61, the processing area determining portion 53, the post processing control portion 55, and the conveyance control portion 67.

The image position determining portion 61, based on the print condition input from the print data generating portion 51, determines an image position in the sheet where an image is formed. The image position is a position of an area in the sheet where the toner image is scheduled to be formed, assuming that a toner image has been formed on the sheet based on the print data. Specifically, the image position determining portion 61 determines a blank area based on the information regarding a blank area of the sheet in which an image is not formed, the information being defined by the image formation condition included in the print condition. Then the image position determining portion 61 determines as the image position a position in an area of the sheet other than the blank area. The image position determining portion 61 outputs image position information indicating the determined image position to the grace period determining portion 63. In many cases, the blank area may be defined in a surrounding area of the sheet.

The processing area determining portion 53 determines a processing area based on the post processing condition included in the print condition input from the print data generating portion 51. The processing area is an area within the sheet, and an area to be processed in the case where the post process is executed by the post processing unit 155. Specifically, in the case where the post processing condition defines a sorting process of sorting one or more sheets for ejection, the processing area determining portion 53 does not determine the processing area. In the case where the post processing condition defines a hole punching process, the processing area determining portion 53 determines as the processing area an area where a hole is punched in the sheet. In the case where the post processing condition defines a stapling process, the processing area determining portion 53 determines as the processing area an area where a staple needle is pressed into the sheet. In the case where the post processing condition defines a folding process, the processing area determining portion 53 determines as the processing area an area where the sheet is folded. In the case where the post processing condition defines a cutting process, the processing area determining portion 53 determines as the processing area an area to be cut from the sheet. Upon determining the processing area, the processing area determining portion 53 outputs to the grace period determining portion 63 processing area information indicating a position of the determined processing area in the sheet.

In the case where the post processing condition is defined by the print condition input from the print data generating portion 51, the post processing control portion 55 controls the post processing unit 155 so as to cause it to execute the post process for one or more sheets on which an image has been formed by the image forming unit 140. The post processing control portion 55 determines a type of the post process defined by the post processing condition. The type of the post process includes: a first type where a sorting process, a hole punching process and a stapling process are predetermined; and a second type where a folding process and a cutting process are predetermined. In the case where the post process defined by the post processing condition is a process of the second type, the post processing control portion 55 outputs a switching instruction to the mode switching portion 65.

In response to an event that the print data is input from the print data generating portion 51, the image forming control portion 57 controls to cause the image forming units 20Y, 20M, 20C and 20K, and the driving roller 33C to form a toner image on the intermediate transfer belt 30 and convey the toner image to the transfer position X. There may be the case where the print data includes a blank part where an image does not exist. The exposure start time is a time when scanning is started based on the print data, and in the case where the print data includes a blank part, the exposure start time is a time when scanning is started for the blank part. It should be noted that, in the case where the blank part is scanned, the exposure head 21Y does not emit laser light. The image forming control portion 57 outputs to the conveyance control portion 67 the exposure start time when the image forming unit 20Y starts forming the toner image.

The mode switching portion 65 switches an operation mode to either a normal mode or an efficiency mode. The mode switching portion 65 switches the operation mode based on an operation that the user inputs to the operation unit 160B. In the case where the operation unit 160B accepts an operation of switching to the efficiency mode, the mode switching portion 65 switches the operation mode to the efficiency mode, while in the case where the operation unit 160B accepts an operation of switching to the normal mode, the mode switching portion 65 switches the operation mode to the normal mode. Further, in the case where the switching instruction is input from the post processing control portion 55 in a state where the operation mode has been switched to the efficiency mode, the mode switching portion 65 switches the operation mode to the normal mode. The mode switching portion 65 outputs the operation mode to the grace period determining portion 63.

The grace period determining portion 63 receives image position information from the image position determining portion 61, and receives the operation mode from the mode switching portion 65. Further, there may be the case where the grace period determining portion 63 receives the area information from the processing area determining portion 53. In the case where the area information is not input from the processing area determining portion 53 in a state where the operation mode is the efficiency mode, the grace period determining portion 63 determines the grace period based on the image position indicated by the image position information. Specifically, the grace period determining portion 63 determines as a grace distance a distance obtained by subtracting an allowable distance from a distance between a tip of a conveyance direction of the sheet (an end point on a downstream side) and a tip of the conveyance direction of an area specified by the image position, and then the grace period determining portion 63 determines as the grace period a value obtained by dividing the grace distance by the toner conveyance speed S. The allowable distance is a value for securing an area on a tip of the sheet, in which an toner image is not formed. The allowable distance may be about several millimeters (mm), for example, 2 mm is preferable. The grace period determining portion 63 outputs the grace period to the conveyance control portion 67.

In the case where the area information is input from the processing area determining portion 53 in a state where the operation mode is the efficiency mode, the grace period determining portion 63 determines the grace period based on the processing area and the image position indicated by the image position information. Specifically, the grace period determining portion 63 determines as the grace distance a distance obtained by subtracting the allowable distance from a distance between a rear end of a conveyance direction of the processing area in the sheet and a tip of the conveyance direction of an area specified by the image position, and then the grace period determining portion 63 determines as the grace period a value obtained by dividing the grace distance by the toner conveyance speed S. The grace period determining portion 63 outputs the grace period to the conveyance control portion 67. In the case where the operation mode is the normal mode, the grace period determining portion 63 does not determine the grace period.

The conveyance control portion 67 receives the print condition from the print data generating portion 51, and receives the exposure start time (the first point of time) from the image forming control portion 57. There may be the case where the conveyance control portion 67 receives the grace period from the grace period determining portion 63. The conveyance control portion 67 controls to cause the paper feed unit 150 in accordance with a conveyance condition included in the print condition to convey the sheet stored in any one of the paper feed cassettes 35, 35A and 35B, to the post processing unit 155 via the transfer position X. The conveyance control portion 67 includes: a conveyance start portion 71; a waiting position detecting portion 73; and a conveyance restart portion 75.

The conveyance start portion 71, in accordance with the paper conveyance condition included in the print condition, selects any one of the paper feed cassettes 35, 35A and 35B. Here, it is assumed as an example that the paper feed cassette 35 is selected. The conveyance start portion 71 drives the ejecting roller 36 so as to eject a sheet stored in the paper feed cassette 35, and drives the paper feed roller 37 so as to convey the sheet along the conveyance path. The conveyance control portion 67 calculates a period DDT obtained by subtracting a maximum value of the preparing period DT1 and the stop period ST from the remaining period T5, and determines as a paper conveyance time, a time before the period DDT elapses from when the exposure start time (the first point of time) has been input. When the paper conveyance time comes, the conveyance start portion 71 drives the ejecting roller 36 to eject the sheet, and drives the paper feed roller 37 to start conveying the sheet.

The waiting position detecting portion 73 stops driving the paper feed roller 37 after the first stop period has elapsed from an event that the timing sensor 39 detected a sheet, so as to stop conveyance of the sheet. Therefore, the sheet is stopped at a position where a tip of the sheet came into contact with the timing roller 31, and further, after the second stop period elapses the timing roller 31 becomes able to convey the sheet. A value obtained by subtracting a period when the first stop period and the second stop period are superimposed from the sum of the first stop period and the second stop period is the stop period ST. After the stop period ST elapses from an event that the timing sensor 39 has detected the sheet, the waiting position detecting portion 73 outputs a paper stop signal to the conveyance restart portion 75.

The conveyance restart portion 75 determines as the adjusting period T3 a period obtained by subtracting the paper conveyance period T2 from the toner conveyance period T1. Further, the conveyance restart portion 75 determines the restart time (the second point of time) when the adjusting period T3 has elapsed from the exposure start time (the first point of time). In the case where the paper stop signal is input from the waiting position detecting portion 73 until the restart time comes, the conveyance restart portion 75 drives the timing roller 31 in response to an event that the restart time comes so as to restart conveying the sheet. Thus, the sheet is conveyed to the transfer position X and the toner image is formed at the image position defined by the image formation condition included in the print condition.

In the case where the grace period is input from the grace period determining portion 63, even though the paper stop signal is not input from the waiting position detecting portion 73 until the restart time comes, the conveyance restart portion 75 drives the timing roller 31 to start conveying the sheet as long as the paper stop signal is input from the waiting position detecting portion 73 before a point of time (a third point of time) when the grace period elapses from the restart time. Thus, the conveyance of the sheet to the transfer position X is delayed by a delay period, and the toner image is formed at a position shifted to a downstream side by a distance corresponding to the delay period from the image position defined by the image formation condition included in the print condition. The delay period is a time period from the restart time to a time when a paper stop signal is input. A distance corresponding to the delay period is a value obtained by multiplying the delay period by the toner conveyance speed S. Further, the conveyance restart portion 75 outputs the delay period to the image forming control portion 57.

Even in the case where the grace period is input from the grace period determining portion 63, if the paper detection signal is not input from the waiting position detecting portion 73 until a time when the grace period elapses from the restart time, the conveyance restart portion 75 stops driving the image forming unit 140 and the paper feed unit 150 so as to display an error screen in the display unit 160A after the grace period elapses from the restart time. The error screen includes, for example, an error message notifying that the sheet has been jammed in the conveyance path. Further, in the case where the grace period is not input from the grace period determining portion 63, in response to an even that the restart time comes, the conveyance restart portion 75 stops driving the image forming unit 140 and the paper feed unit 150 to display the error screen in the display unit 160A as long as the paper detection signal is not input from the waiting position detecting portion 73 until the restart time comes.

The image forming control portion 57 includes a change portion 77. In the case of forming a toner image on each of a plurality of pages, the image forming control portion 57 forms the toner image at an image formation interval defined by a size of the sheet on which the toner image is transferred. In response to an event that the delay period is input, the change portion 77 delays by a period corresponding to the delay period the exposure start time when formation of the toner image is started based on the print data for the next page. For example, the shortest paper interval obtained from view of configuration and an allowable minimum of the paper interval are predetermined. Since the paper interval becomes the shortest at the timing roller 31, the shortest paper interval obtained from view of configuration for the paper feed cassette 35 is an interval between the preceding sheet and the next sheet at the timing roller 31 in the case where a preceding sheet is supplied by a maximum value of the preparing period DT1, and the next sheet is supplied by a minimum value of the preparing period DT1. It is here assumed that a period of conveying the sheet only by a distance of the shortest paper interval obtained from view of configuration is a shortest interval period, and a period of conveying the sheet only by a distance of an allowable minimum paper interval is a minimum interval period. There may be the case where, if the delay period becomes equal to or more than the the shortest interval period, the paper interval cannot be maintained. Therefore, a value obtained by subtracting the shortest interval period from the delay period is set to an overlap avoiding value as a correction value necessary for avoiding an overlap between the preceding sheet and the next sheet. Accordingly, in order to secure the allowable minimum paper interval, a value obtained by adding the minimum interval period to the overlap avoiding value is determined as a correction time for changing the exposure start time. The image forming control portion 57 changes the next exposure start time to a period elapsed only by the correction time. Thus, in the case where sheets are continuously conveyed, even though the conveyance of the sheet is delayed, it is possible to prevent the delayed sheet and the next sheet from colliding and overlapping in the conveyance path.

Figure 5:
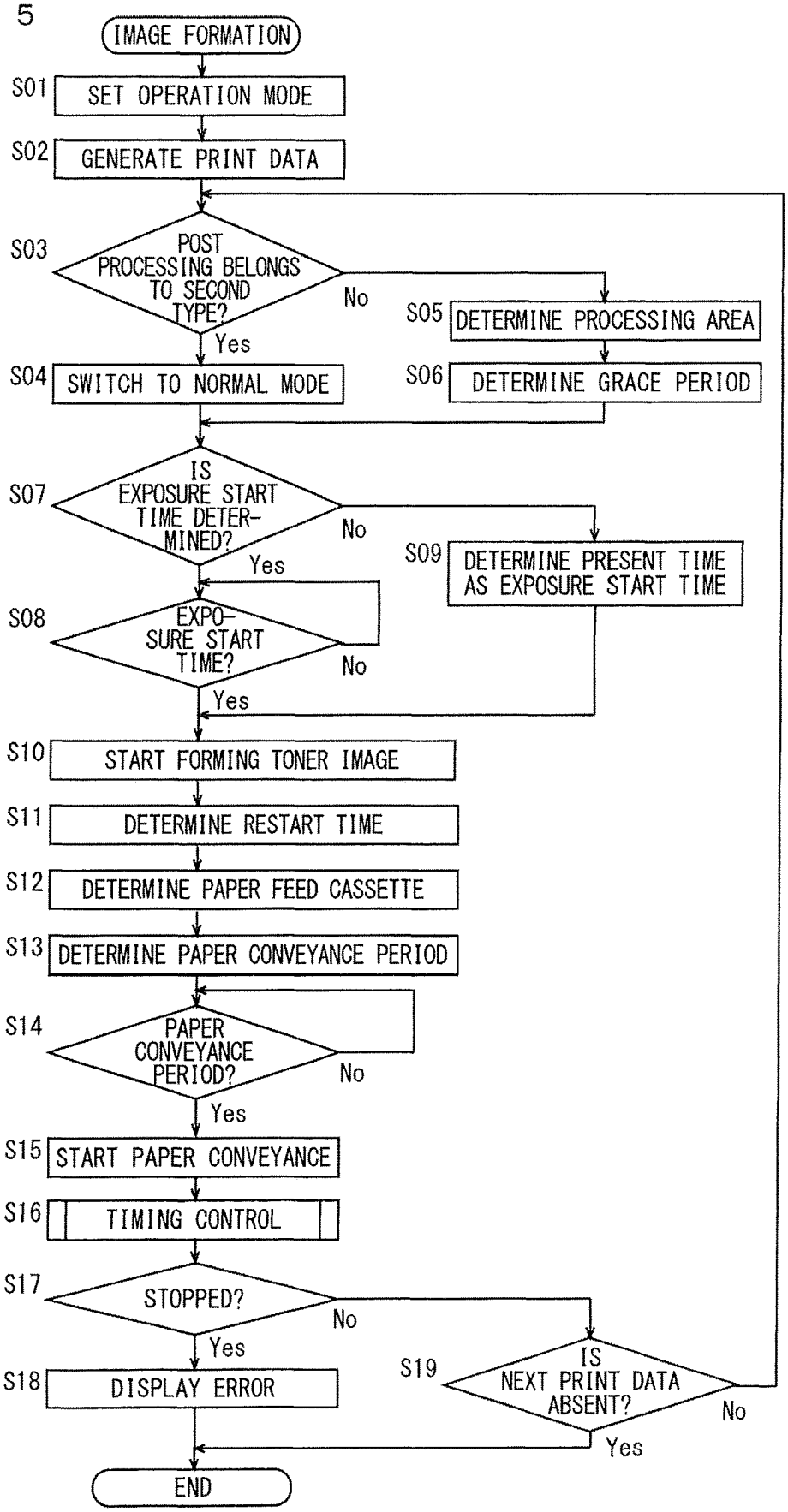
FIG. 5 is a flow chart showing an example of a flow of an image forming processing.

FIG. 5 is a flow chart showing an example of a flow of an image forming processing. The image forming processing is a process executed by the CPU 111 as the CPU 111 included in the MFP 100 executes an image forming program stored in the ROM 113, HDD 116 or the CD-ROM 119A. Referring to FIG. 5, the CPU 111 sets the operation mode (step S01). The CPU 111 sets the operation mode to either the normal mode or the efficiency mode in accordance with an operation that the user inputs to the operation unit 160B. It should be note that, the operation mode may be set as default to either the normal mode or the efficiency mode. Here, it will be described as an example that the operation mode is set to the efficiency mode.

In the following step S02, the CPU 111 generates the print data based on the data and the print condition, and the process proceeds to step S03. In the step S03, the CPU 111 determines, based on the post processing condition included in the print condition, whether the post process is a process of the second type or not. Here, a sorting process, a hole punching process and a stapling process are predetermined as the first type, while a folding process and a cutting process are predetermined as the second type. In the case where the post process defined by the post processing condition is any one of the folding process and the cutting process, the CPU 111 determines that the post process is a process of the second type, and the process proceeds to step S04; otherwise, the process proceeds to step S05. In the step S04, the CPU 111 switches the operation mode to the normal mode, and the process proceeds to step S07.

In the step S05, the CPU 111 determines the processing area based on the post processing condition included in the print condition, and the process proceeds to step S06. The processing area is an area within the sheet, which is processed in the case where the post process is executed by the post processing unit 155. In the case where a sorting process is determined by the post processing condition, the CPU 111 does not determine the processing area. In the case where a hole punching process is determined, the CPU 111 determines as the processing area an area where a hole is punched in the sheet, and in the case where a stapling process is determined, the CPU 111 determines as the processing area an area where a staple needle is pressed into the sheet.

In the step S06, the CPU 111 determines the grace period and the process proceeds to step S07. Specifically, in the case where the processing area is not determined in the step S05, the CPU 111 determines as the grace distance a distance from a tip of a conveyance direction of the sheet to a tip of the conveyance direction of an area specified by the image position defined by the image formation condition, and the CPU 111 determines as the grace period a value obtained by dividing the grace distance by the toner conveyance speed S. In the case where the processing area is determined in the step S05, the CPU 111 determines as the grace distance a distance between a rear end of a conveyance direction of the processing area in the sheet and a tip of the conveyance direction of an area specified by the image position, and the CPU 111 determines as the grace period a value obtained by dividing the grace distance by the toner conveyance speed S.

In the step S07, the CPU 111 determines whether the exposure start time is determined or not. The exposure start time is determined in a timing control processing which will be described later. In the case where the step S07 is executed at first, the exposure start time is not determined. If the exposure start time is determined, the process proceeds to step S08; otherwise, the process proceeds to step S09. In the step S09, the CPU 111 determines the present time as the exposure start time, and the process proceeds to the step S10. In the step S08, the CPU 111 stays in a waiting state until the exposure start time comes, and when the present time comes to the exposure start time, the process proceeds to step S10. The exposure start time is a first point of time when the exposure head 21Y start forming the electrostatic latent image on the photoreceptor drum 23Y.

In the step S10, the CPU 111 starts forming the toner image, and the process proceeds to step S11. Specifically, the CPU 111 controls to cause the image forming units 20Y, 20M, 20C and 20K, and the driving roller 33C to start forming the toner image based on the print data.

In the step S11, the CPU 111 determines the restart time. The restart time is a second point of time when the adjusting period T3 obtained by subtracting the paper conveyance period T2 from the toner conveyance period T1 elapses from the exposure start time. The toner conveyance period T1 is a fixed value predetermined, which is a time period from when the exposure head 21Y starts forming the electrostatic latent image on the photoreceptor drum 23Y until when the toner image reaches the transfer position X. The paper conveyance period T2 is a fixed value predetermined, which is a time period from when the timing roller 31 starts driving until when a tip of the sheet conveyed by the timing roller 31 reaches the transfer position X, as well as which is a value obtained by dividing the paper conveyance distance L2 by the toner conveyance speed S.

In the following step S12, the CPU 111 determines a paper feed cassette, and the process proceeds to step S13. The CPU 111 determines the paper feed cassette defined by the image formation condition, among the paper feed cassettes 35, 35A and 35B. Here, it will be described as an example that the case where the paper feed cassette 35 is determined. Then, the CPU 111 determines the paper conveyance period (the step S13), and the process proceeds to step S14. The paper conveyance period is a time period before the period DDT elapses from the exposure start time. The period DDT is a time period obtained by subtracting a maximum value of the preparing period DT1 and the stop period ST from the remaining period T5. The remaining period T5 is a time period obtained by subtracting the paper conveyance period T2 from the toner conveyance period T1. The preparing period DT1 is a time period defined from view of configuration as a period for conveying the sheet from the paper feed cassette 35 to the timing sensor 39, and the preparing period DT1 includes a predetermined range.

In the step S14, the CPU 111 determines whether the present time comes to the paper conveyance time or not. The CPU 111 stays in the waiting state until the present time comes to the paper conveyance time (No in the step S14), and when the present time comes to the paper conveyance time (YES in the step S14), the process proceeds to step S15. In the step S15, the CPU 111 starts conveying the sheet, and the process proceeds to step S16. Specifically, the CPU 111 drives the ejecting roller 36 to eject the sheet stored in the paper feed cassette 35, and drives the paper feed roller 37 to convey the sheet along the conveyance path to the timing roller 31.

Accordingly, the CPU 111 executes the timing control processing (the step S16), and the process proceeds to step S17. In the step S17, the CPU 111 determines from a result of the timing control processing whether the image forming unit 140 and the paper feed unit 150 are stopped or not. If the image forming unit 140 and the paper feed unit 150 are stopped, the process proceeds to step S18; otherwise, the process proceeds to step S19. In the step S19, the CPU 111 determines whether the print data exists for the next page or not. If the print data exists for the next page, the process returns to the step S03; otherwise, the process ends. In the step S18, the CPU 111 displays the error screen in the display unit 160A, and the process ends. The error screen includes, for example, an error message notifying that the sheet has been jammed in the conveyance path.

Figure 6:
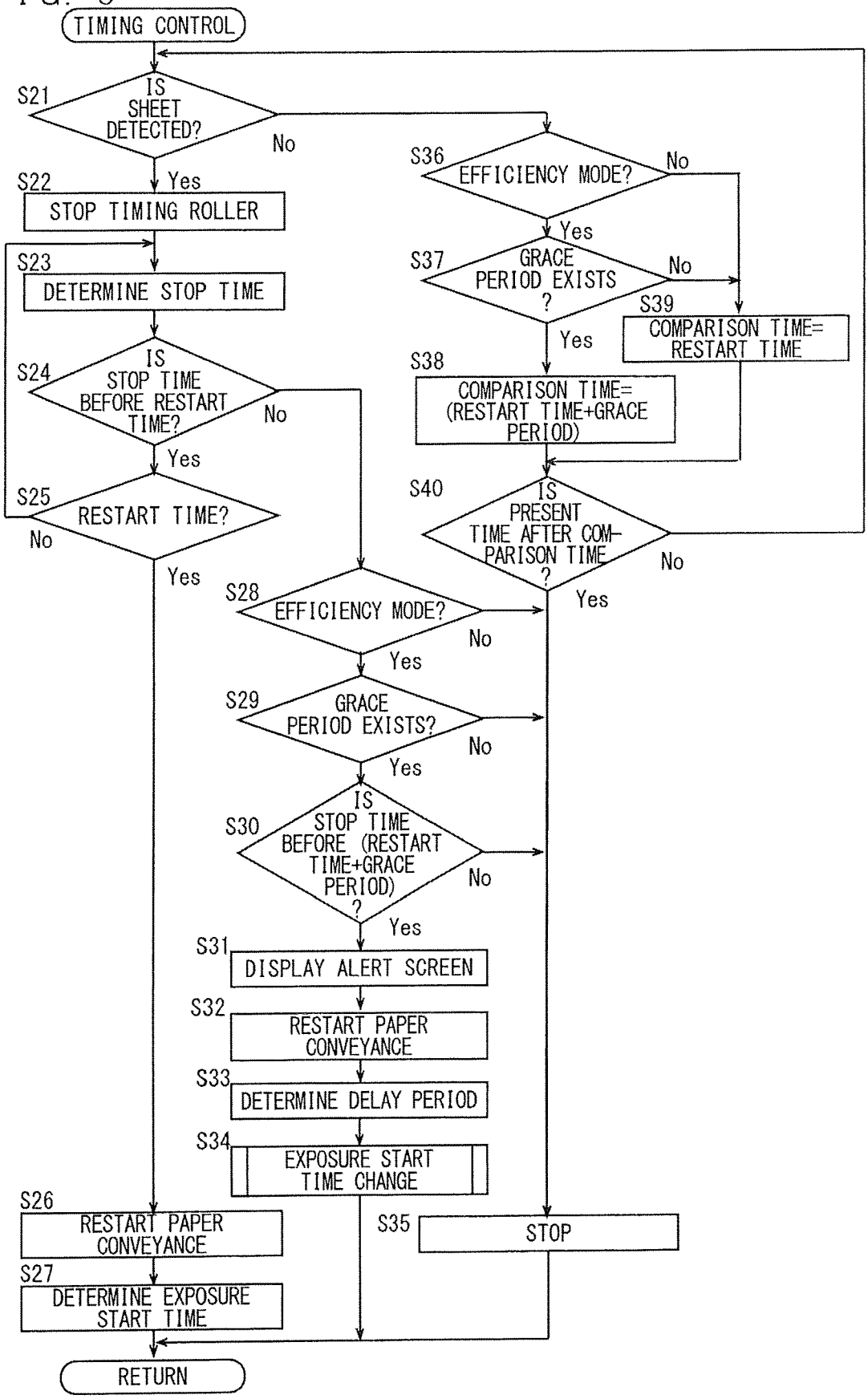
FIG. 6 is a flow chart showing an example of a flow of a timing control processing.

FIG. 6 is a flow chart showing an example of a flow of a timing control processing. The timing control processing is a process executed in the step S16 of FIG. 5. At a stage before the timing control processing is executed, formation of the toner image has been started by the image forming units 20Y, 20M, 20C and 20K, as well as conveyance of the sheet has been started by the paper feed unit 150. Referring to FIG. 6, the CPU 111 determines whether the timing sensor 39 detects the sheet or not (step S21). If the timing sensor 39 detects the sheet, the process proceeds to step S22; otherwise, the process proceeds to step S36.

In the step S36, the CPU 111 determines whether the operation mode is set to the efficiency mode or not. If the operation mode is set to the efficiency mode, the process proceeds to step S37; otherwise, the process proceeds to step S39. In the step S37, the CPU 111 determines whether the grace period is determined or not. If the grace period is determined in the step S06 in FIG. 5, the process proceeds to step S38; otherwise, the process proceeds to the step S39. In the step S38, the CPU 111 sets a comparison time to a time after the grace period elapses from the restart time, and the process proceeds to step S40. In the step S39, the CPU 111 sets the comparison time to the restart time, and the process proceeds to the step S40. In the step S40, the CPU 111 determines whether the present time is a time after the comparison time or not. If the present time is a time after the comparison time, the process proceeds to step S35; otherwise, the process returns to the step S21.

In the step S22, the CPU 111 stops the sheet at a position where a tip of the sheet reaches a position of the timing roller 31, and the process proceeds to step S23. Specifically, the CPU 111 stops the paper feed roller 37 at a point of time when the first stop period elapses from when the timing sensor 39 detects the sheet. In the step S23, the CPU 111 determines the stop time, and the process proceeds to step S24. The CPU 111 determines as the stop time a time after the predetermined stop period ST elapses from when the timing sensor 39 detects the sheet. In the step S24, the CPU 111 determines whether the stop time is before the restart time or not. The restart time is a time which is determined in the step S11 in FIG. 5. If the stop time is before the restart time, the process proceeds to step S25; otherwise, the process proceeds to step S28.

In the step S25, the CPU 111 determines whether the present time comes to the restart time or not. The CPU 111 stays in the waiting state until the present time comes to the restart time (No in the step S25), and when the present time comes to the restart time (YES in the step S25), the process proceeds to step S26. In the step S26, the CPU 111 restarts conveying the sheet, and the process proceeds to step S27. Specifically, the CPU 111 drives the timing roller 31. Accordingly, conveyance of the sheet is restarted, the sheet is conveyed to the transfer position X, and thus, the toner image is formed at the image position defined by the image formation condition included in the print condition.

In the step S27, the CPU 111 determines the exposure start time, and the process returns to the image forming processing. The exposure start time is, if the sheet is not delayed, a time which is set at an interval corresponding to a size of the sheet. Therefore, in the step S27 where the process proceeds from the step S26, the CPU 111 determines as a new exposure start time a time after a predetermined period elapses from the exposure start time being currently set.

Meanwhile, the case where the process proceeds to the step S28 is a case where the stop time elapses the restart time. In the step S28, the CPU 111 determines whether the operation mode is set to the efficiency mode or not. If the operation mode is set to the efficiency mode, the process proceeds to step S29; otherwise, the process proceeds to the step S35. In the step S29, the CPU 111 determines whether the grace period is determined or not. If the grace period is determined in the step S06 in FIG. 5, the process proceeds to step S30; otherwise, the process proceeds to the step S35. In the step S35, the CPU 111 stops the image forming unit 140 and the paper feed unit 150, and the process returns to the image forming processing.

In the step S30, the CPU 111 determines whether the stop time is before the second point of time when the grace period elapses from the restart time or not. If the stop time is before the second point of time, the process proceeds to step S31; otherwise, the process proceeds to the step S35. In the step S31, the CPU 111 displays an alert screen in the display unit 160A, and the process proceeds to step S32. The alert screen includes, for example, a message notifying that an image is formed to be shifted. In the step S32, likewise in the step S26, the CPU 111 restarts conveying the sheet, and the process proceeds to step S33. Then, the CPU 111 determines the delay period (in the step S33), and the process proceeds to step S34. In the step S33, the CPU 111 determines as the delay period a period from the restart time to the stop time. In the step S34, the CPU 111 executes an exposure start time changing processing, and the process returns to the image forming processing.

Figure 7:
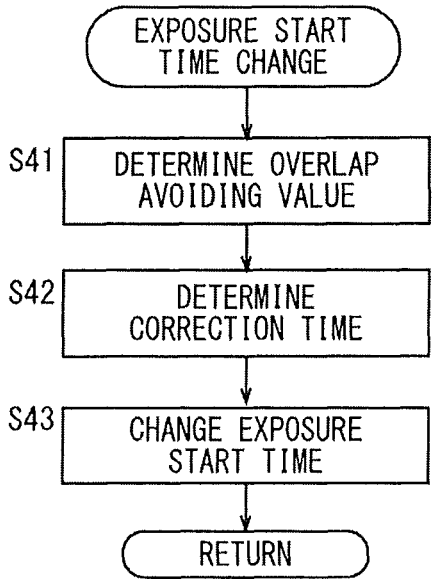
FIG. 7 is a flow chart showing an example of a flow of an exposure start time changing processing.

FIG. 7 is a flow chart showing an example of a flow of the exposure start time changing processing. Referring to FIG. 7, the CPU 111 determines the overlap avoiding value (step S41). The CPU 111 sets as the overlap avoiding value a value obtained by subtracting the shortest interval period from the delay period. The shortest interval period for the paper feed cassette 35, for example, is an interval between the preceding sheet and the next sheet in the case where a preceding sheet is supplied by the maximum value of the preparing period DT1, and the next sheet is supplied by the minimum value of the preparing period DT1.

Accordingly, the CPU 111 determines the correction time (step S42). The CPU 111 determines as the correction time for changing the exposure start time, a period obtained by adding the minimum interval period to the overlap avoiding value. The minimum interval period is a predetermined value as an allowable minimum of a paper interval. Then, the CPU 111 changes the next exposure start time to a time after the correction time elapses (step S43), and the process returns to the timing control processing.

Figure 8:
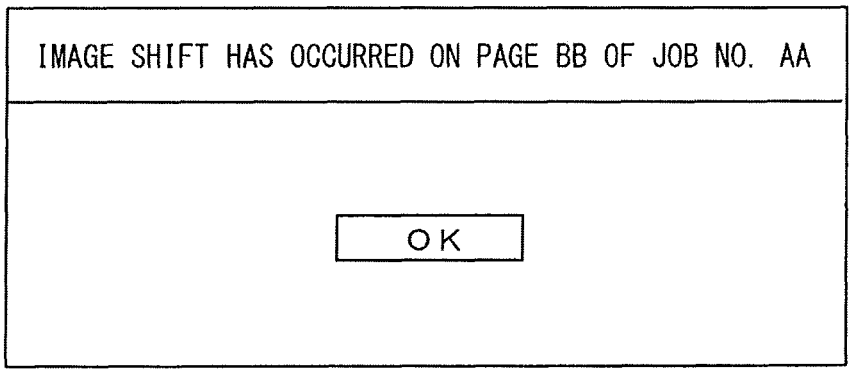
FIG. 8 is a diagram showing an example of an alert screen.

FIG. 8 is a diagram showing an example of the alert screen. Referring to FIG. 8, an alert screen 300 includes: a job number "AA" for identifying a job targeted for image formation; and a page number "BB" for identifying, from among a plurality of pages included in the job, a page in which a shift occurs in the image. This allows the user to readily specify, from among the plurality of sheets, a sheet in which the image is formed to be shifted.

First Embodiment

FIG. 9 is a diagram showing an example of a distance and a conveyance period for every path according to the embodiments. Referring to FIG. 9, a conveyance path of the toner image is a path where the toner image is conveyed (a toner conveyance distance L1), which is between a position where the photoreceptor drum 23Y is exposed and the transfer position X. The toner conveyance distance L1 is set to 300 mm, and the toner conveyance period T1 is set to 1000 ms. It is here assumed that the toner conveyance speed S is set to 300 mm/s. A paper path 1 is a path between the timing roller 31 and the transfer position X (a paper conveyance distance L2). The paper conveyance distance L2 is set to 100 mm, and the paper conveyance period T2 is set to 333 ms.

A paper path 2 is a path where the sheet is conveyed, which is between the timing sensor 39 and the timing roller 31. The paper path 2 is set to 50 mm in distance. A period when a tip of the sheet moves in the paper path 2 becomes 100 ms. It is here assumed that the paper conveyance speed SS is set to 500 mm/s.

A paper path 3 is a path where the sheet is conveyed, which is between the paper feed cassette 35 and the timing sensor 39. The paper path 2 for the paper feed cassette 35 is set to 130 mm in distance. The preparing period DT1 for conveying the sheet in the paper path 2 is set to equal to or more than 270 ms as well as equal to or less than 300 ms.

FIG. 10 is a diagram showing a value of a predetermined interval according to the embodiments. Referring to FIG. 10, an interval of the exposure start time is set to 850 ms. The interval of the exposure start time is a time period between a first exposure start time of starting formation of the toner image on a sheet and a second exposure start time of starting formation of the toner image on the next sheet. The interval of the exposure start time is defined by a size of the sheet and a paper interval. It is here assumed that for the paper interval, the second stop period is set to 50 ms and an allowable minimum value is set to 20 ms. The second stop period is a time period from when the sheet reaches the timing roller 31 until the timing roller 31 becomes able to convey the sheet.

FIG. 11 is a diagram showing an elapsed period from the exposure start time for every event for a sheet. Here, it will be described as an example that the sheet stored in the paper feed cassette 35 is conveyed. Referring to FIG. 11, the CPU 111 starts conveying the sheet stored in the paper feed cassette 35 after 217 ms from the exposure start time. The timing sensor 39 detects the sheet after 487 ms at the earliest or 517 ms at the latest from the exposure start time. Since a period of conveying the sheet from the timing roller 31 to the timing sensor 39 is 100 ms, the sheet reaches the timing roller 31 after 587 ms at the earliest and 617 ms at the latest from the exposure start time.

A timing when the paper feed roller 37 is stopped is after 110 ms as the first stop period from when the timing sensor 39 detects the sheet. Therefore, the paper feed roller 37 is stopped after 597 ms at the earliest and 627 ms at the latest from the exposure start time. Since a period during which the paper feed roller 37 conveys the sheet from the timing sensor 39 to the timing roller 31 is 100 ms, the paper feed roller 37 is stopped after 10 ms from when the sheet reaches the timing sensor 39. Therefore, a length of the sheet which exists between the paper feed roller 37 and the timing roller 31 becomes longer than a path length by a distance where the paper feed roller 37 conveys the sheet for 10 ms, and thus the sheet becomes deflected.

Since the toner conveyance period T1 is 1000 ms and the paper conveyance period T2 is 333 ms, the restart time when conveyance of the sheet is restarted by the timing roller 31 is a time after 667 ms elapses from the exposure start time. Thus, at a point of time when 1000 ms elapses from the exposure start time, a tip of the sheet reaches the transfer position X. Further, the second stop period from when the sheet reaches the timing roller 31 until the timing roller 31 becomes able to convey the sheet is set to 50 ms. Therefore, the first stop period and the second stop period are overlapped by 10 ms, and thus the stop period ST becomes 150 ms.

Further, a time when a rear end of the sheet conveyed by the timing roller 31 passes through the timing sensor 39 is a time after 1200 ms elapses from the exposure start time. A time period during which the sheet is conveyed by a distance (50 mm) from the timing roller 31 to the timing sensor 39 is 167 ms. 1200 ms is a value obtained by adding 700 ms for conveying the sheet to 667 ms for starting conveyance, and further subtracting 167 ms therefrom. Further, a time when a rear end of the sheet conveyed by the timing roller 31 passes through the timing roller 31 is a time after 1367 ms elapses from the exposure start time. 1367 ms is a value obtained by adding 700 ms for conveying the sheet to 667 ms for starting conveyance.

Figure 12:
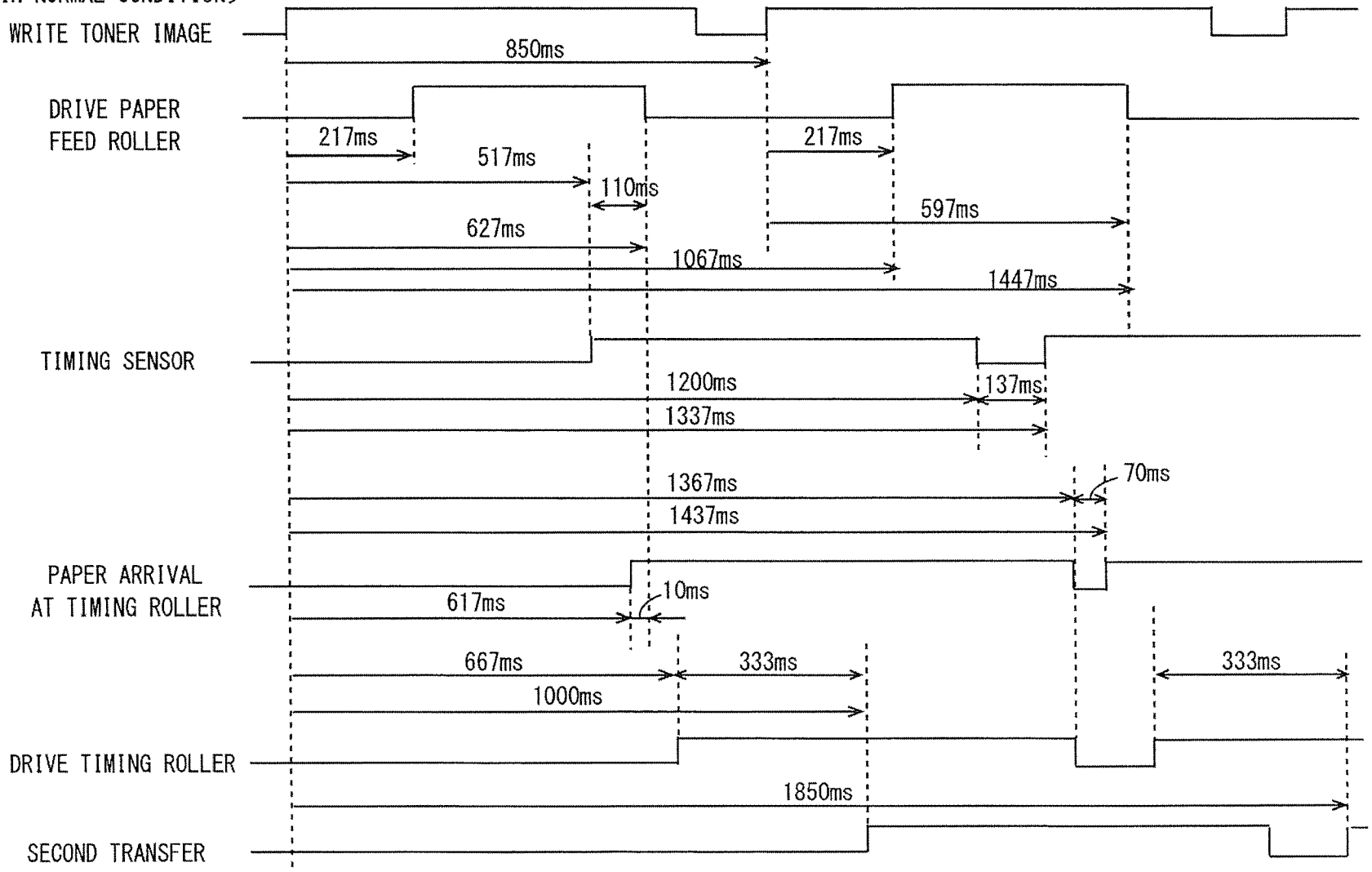
FIG. 12 is a diagram showing a state of each member and a position of a sheet in the case where the sheet is not delayed.

FIG. 12 is a diagram showing a state of each member and a position of a sheet in the case where the sheet is not delayed. Referring to FIG. 12, the paper feed roller 37 starts driving after 217 ms from the first exposure start time. Then, when the timing sensor 39 detects a first sheet after 517 ms from the first exposure start time, the paper feed roller 37 is stopped, 110 ms thereafter, at 627 ms. The first sheet reaches the timing roller 31 after 617 ms from the first exposure start time, namely, before 10 ms from when the paper feed roller 37 is stopped. Next, the toner image reaches the transfer position X after 1000 ms from the first exposure start time, but 333 ms therebefore (after 667 ms from the first exposure start time), the timing roller 31 starts driving to restart conveyance of the first sheet. The first sheet is conveyed by the timing roller 31 from the first exposure start time to 1367 ms. Upon this occasion, the timing sensor 39 detects the first sheet from the first exposure start time to 1200 ms.

Meanwhile, for the next second sheet, the paper feed roller 37 starts driving after 1067 ms from the first exposure start time, and the timing sensor 39 detects the second sheet after 1337 ms from the first exposure start time. A time when the timing sensor 39 detects the second sheet is after 137 ms from a time when the timing sensor 39 detects the first sheet at last.

Accordingly, the paper feed roller 37 is stopped after 1447 ms from the first exposure start time. The second sheet reaches the timing roller 31 after 1437 ms from the first exposure start time, 10 ms before when the paper feed roller 37 is stopped. A time when the second sheet reaches the timing roller 31 is after 70 ms from when the first sheet passes through the timing roller 31. Therefore, the shortest interval period as the shortest paper interval obtained from view of configuration is 70 ms. Next, the toner image reaches the transfer position X after 1850 ms from the first exposure start time, but 333 ms therebefore, the timing roller 31 starts driving to restart conveyance of the sheet. In the case where the operation mode is the normal mode, unless the timing roller 31 becomes able to convey the sheet until the restart time, it is determined as an error.

In the case where the operation mode is the efficiency mode, if a distance in the conveyance direction of a blank area from a tip of the sheet to the image position is set to 24 mm and the allowable distance is set to 2 mm, the grace distance becomes 22 mm. The grace period is a value obtained by dividing the grace distance by the toner conveyance speed S, then becomes 73 ms in this case. Therefore, until 73 ms elapses from the restart time, if the timing roller 31 is able to convey the sheet, conveyance of the sheet is restarted, whereas if the timing roller 31 is not able to convey the sheet, it is determined as an error. Since the stop period ST is 150 ms, if the timing sensor 39 detects the sheet before 77 ms from the restart time (after 590 ms from the exposure start time), conveyance of the sheet is continued, whereas if the timing sensor 39 does not detect the sheet before 77 ms from the restart time, it is determined as an error.

In the case where the operation mode is the efficiency mode, if the delay period is 73 ms, the toner image is formed to be shifted in the conveyance direction of the sheet by 22 mm (73 ms×300 mm/s), and the blank area of the sheet is 2 mm. Likewise, an arrangement of the toner image in the sheet is different from an arrangement defined by the image formation condition, however, the entirety of the toner image is formed on the sheet. Since the toner image is not formed in an area of 2 mm from a tip of the conveyance direction of the sheet, it is possible to facilitate separation of the sheet from the fixing roller pair 32 and to prevent the sheet on which toner has been transferred at the transfer position X from winding around the fixing roller pair 32.

In the case where conveyance of the sheet is delayed, if the next exposure start time is set after 850 ms from the previous exposure start time, there may be the case where a succeeding sheet reaches the timing roller 31 before the delayed sheet passes through the timing roller 31. For example, in the case where a period when conveyance of the sheet is delayed is 73 ms the same as the grace period, the delay period is 73 ms. If the delay period is 73 ms, a time when the delayed sheet passes through the timing roller 31 is after 1440 ms (1367 ms+73 ms) from the first exposure start time. There may be the case where the succeeding sheet following the delayed sheet reaches the timing roller 31 after 587 ms at the shortest from the second exposure start time which is after 850 ms from the first exposure start time. A time after 587 ms from the second exposure start time is 1437 ms from the first exposure start time. Therefore, the delayed sheet and the succeeding sheet are overlapped in the timing roller 31 by a length corresponding to 3 ms. 3 ms for the sheets being overlapped can be obtained from a difference between the delay period (73 ms) and the shortest interval period (70 ms). Therefore, in the case where a minimum value of the paper interval is set to 20 ms, it is necessary to delay the second exposure start time by a time period corresponding to 23 ms which is obtained by adding 3 ms for avoiding an overlap to 20 ms as a minimum value of the paper interval. Further, in the case where the delay period is equal to or less than 50 ms, it is possible to secure 20 ms as a minimum value of the paper interval without correcting the second exposure start time.

Figure 13:
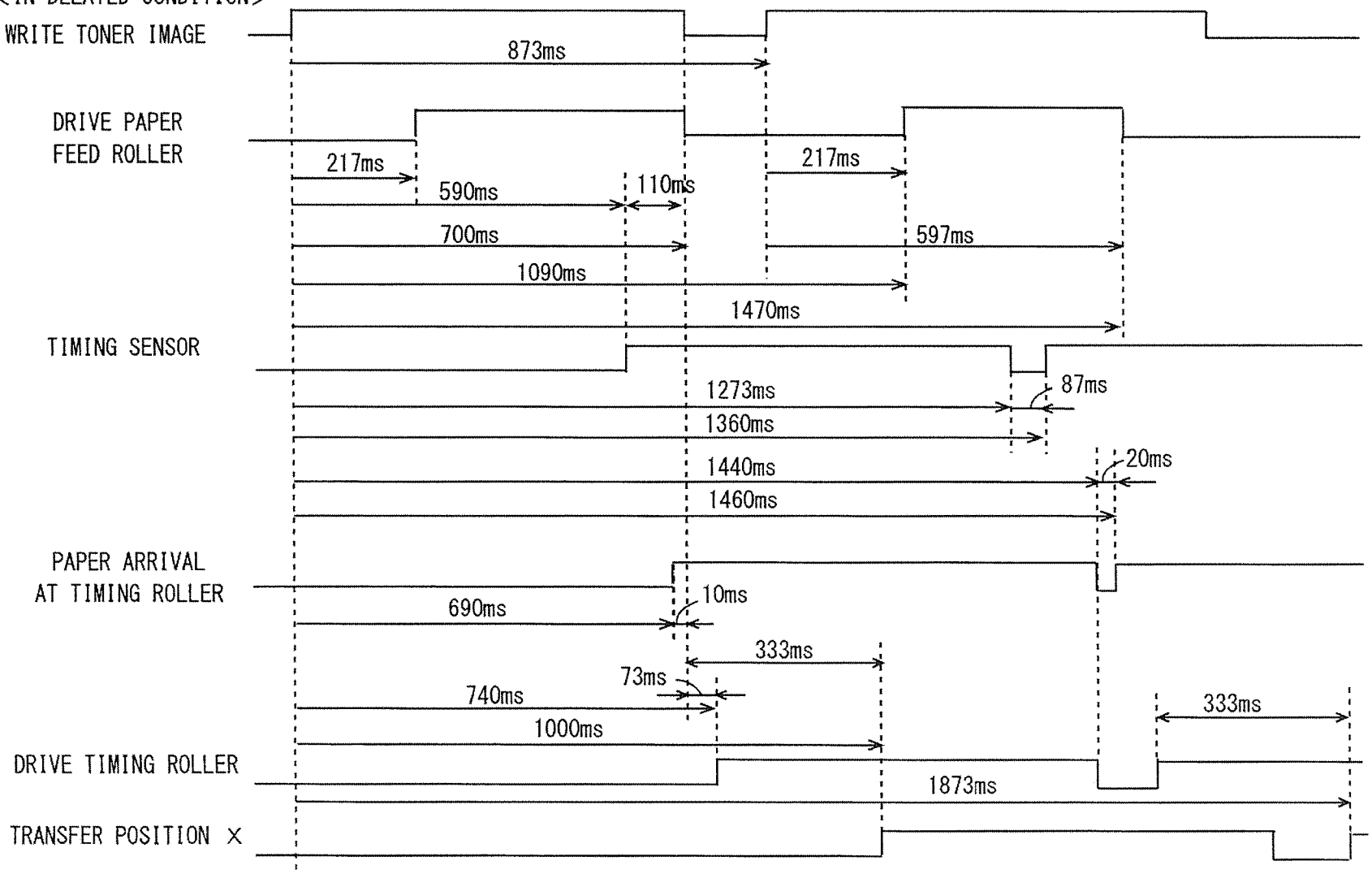
FIG. 13 is a diagram showing a state of each member and a position of a sheet in the case where the sheet is delayed.

FIG. 13 is a diagram showing a state of each member and a position of a sheet in the case where the sheet is delayed. It is here assumed as an example that the delay period is 73 ms. Referring to FIG. 13, the paper feed roller 37 starts driving after 217 ms from the first exposure start time. Then, when the timing sensor 39 detects the first sheet after 590 ms from the first exposure start time, the paper feed roller 37 is stopped, 110 ms thereafter, at 700 ms. The first sheet reaches the timing roller 31 before 10 ms from when the paper feed roller 37 is stopped, namely, after 690 ms from the first exposure start time. Next, the toner image reaches the transfer position X after 1000 ms from the first exposure start time, but the timing roller 31 starts driving after 740 ms from the first exposure start time to restart conveyance of the first sheet. Since the delay period is 73 ms, the toner image is formed to be shifted by 22 mm corresponding to the delay period.

The first sheet is conveyed by the timing roller 31 from the first exposure start time to 1440 ms. Upon this occasion, the timing sensor 39 detects the first sheet from the first exposure start time to 1273 ms.

Since the delay period is 73 ms, the second exposure start time is delayed by 23 ms. Therefore, for the next second sheet, the paper feed roller 37 starts driving after 1090 ms from the first exposure start time, and the timing sensor 39 detects the second sheet after 1360 ms from the first exposure start time. A time when the timing sensor 39 detects the second sheet is after 87 ms from when the timing sensor 39 detects the first sheet at last.

Accordingly, the paper feed roller 37 is stopped after 1470 ms from the first exposure start time. The second sheet reaches the timing roller 31 after 1460 ms from the first exposure start time (10 ms before when the paper feed roller 37 is stopped). A time when the second sheet reaches the timing roller 31 is after 20 ms from when the first sheet passes through the timing roller 31. Next, the toner image reaches the transfer position X after 1873 ms from the first exposure start time, but 333 ms therebefore, the timing roller 31 starts driving to restart conveyance of the sheet.

Likewise, in the case where the first sheet is delayed after 73 ms from the first exposure start time, in place of an event where the second exposure start time is set after 850 ms from the first exposure start time, the second exposure start time is changed after 873 ms from the first exposure start time. Therefore, it is possible to secure 20 ms at least as an interval between the first sheet and the second sheet.

Meanwhile, in the case where the sheet does not reach the timing roller 31 even though 850 ms elapses from the first exposure start time, the second exposure start time may be extended until the grace period elapses from the restart time after 667 ms from the first exposure start time so as that it is determined as an error, the correction value may be determined at a point of time when the timing sensor 39 detects the sheet, and thus, the second exposure start time may be determined.

First Modified Embodiment

The MFP 100 according to the first modified embodiment is configured to allow missing of an image.

Figure 14:
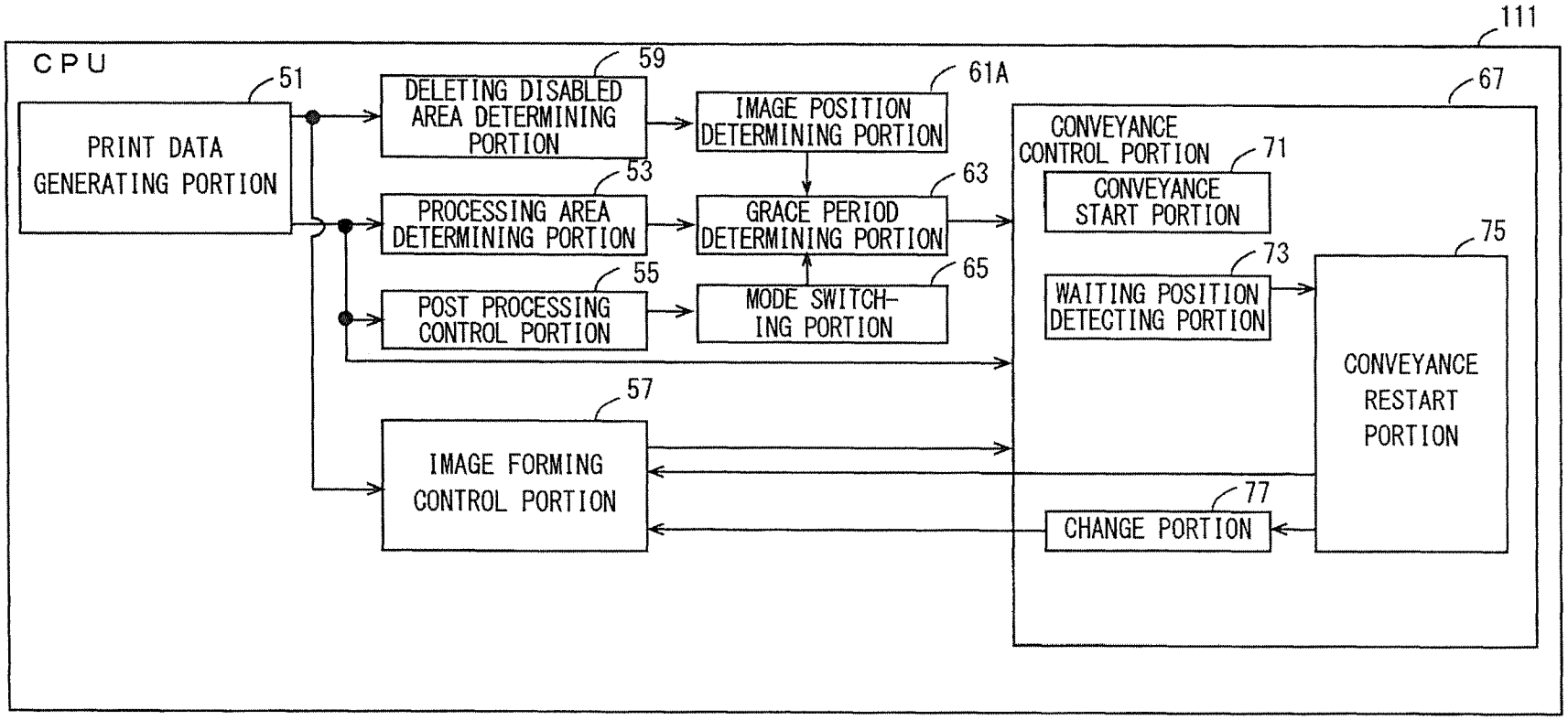
FIG. 14 is a block diagram showing an example of functions of a CPU included in the MFP according to the first modified embodiment.

FIG. 14 is a block diagram showing an example of functions of a CPU included in the MFP according to the first modified embodiment. Functions shown in FIG. 14 are different from functions shown in FIG. 4 in a point where a deleting disabled area determining portion 59 is added, and the image position determining portion 61 is changed to an image position determining portion 61A. Other functions are the same as shown in FIG. 4, and therefore, the description thereof will not repeated.

The deleting disabled area determining portion 59 determines a deleting disabled area in a sheet based on the print data input from the print data generating portion 51. The deleting disabled area is an area within the sheet on which a toner image is scheduled to be formed based on the print data, and is an area necessary to be included in the sheet for the toner image. The deleting disabled area determining portion 59 outputs the print data and the deleting disable area to the image position determining portion 61A.

The image position determining portion 61A predicts a position of the deleting disabled area within the sheet based on the print data and the deleting disabled area, and determines as the image position the predicted position within the sheet. The image position determining position 61A outputs the determined image position to the grace period determining portion 63.

Figure 15:
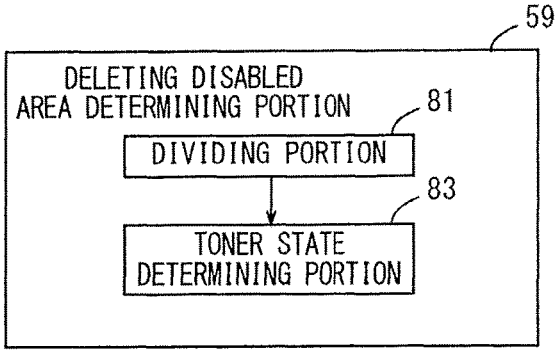
FIG. 15 is a block diagram showing an example of detailed functions of a deleting disabled area determining portion according to the first modified embodiment.

FIG. 15 is a block diagram showing an example of detailed functions of the deleting disabled area determining portion according to the first modified embodiment. Referring to FIG. 15, the deleting disabled area determining portion 59 according to the first modified embodiment includes a dividing portion 81 and a toner state determining portion 83. The dividing portion 81 divides the print data input from the print data generating portion 51 into a plurality of rectangular areas in a sub scanning direction, and outputs the plurality of rectangular areas to the toner state determining portion 83.

The toner state determining portion 83 calculates a toner occupancy ratio for each of the plurality of rectangular areas based on the print data. The toner occupancy ratio is a ratio occupied by a pixel having one or more pixel values. Since the print data has four kinds including yellow, magenta, cyan and black, the toner state determining portion 83 calculates a ratio of a pixel occupying the area, the pixel being included in any one of four pieces of the print data as well as having one or more pixel values. Further, the toner state determining portion 83 determines maximum density for each of the plurality of rectangular areas. Since the print data has four kinds including yellow, magenta, cyan and black, the toner state determining portion 83 determines maximum density for all of four pieces of the print data.

The deleting disabled area determining portion 59 determines as a deleting disabled area an area among the plurality of rectangular areas, in which the toner occupancy ratio is equal to or more than a predetermined threshold value TH1, or the maximum density is equal to or more than a predetermined threshold value TH2. The deleting disabled area determining portion 59 outputs the determined one or more deleting disabled areas to the image position determining portion 61A.

Second Embodiment

Figure 16:
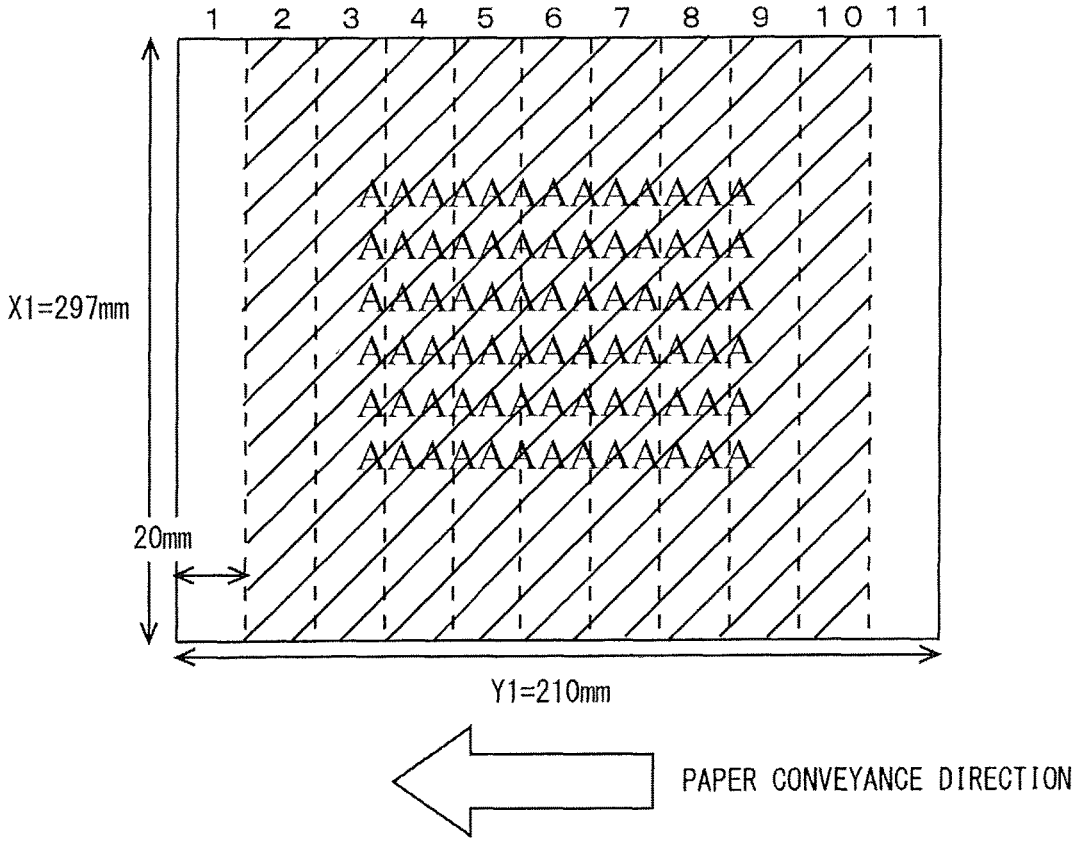
FIG. 16 is a diagram schematically showing an example of print data according to the first modified embodiment.

FIG. 16 is a diagram schematically showing an example of the print data according to the first modified embodiment. FIG. 16 shows a state where the toner image is superimposed on a sheet. A lateral direction of the sheet is a sub scanning direction in which the sheet is conveyed. The left side of the sheet is a tip of the conveyance direction. An area of the toner image is shown by hatching. The sheet is divided in the sub scanning direction into eleven areas. Here, each of the eleven areas has 20 mm length in the sub scanning direction. The eleven areas are provided with area numbers starting from 1 to 11 in order from the left.

Figures 17, 18:
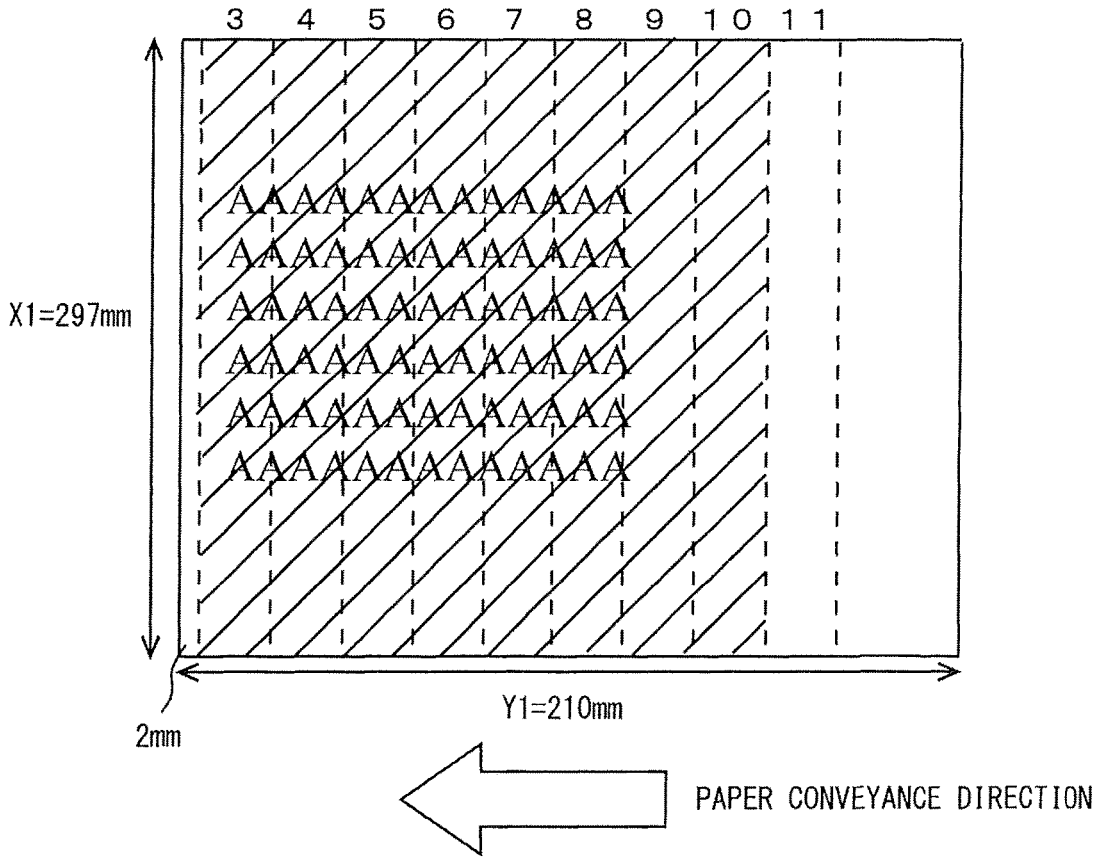
FIG. 17 is a diagram showing an example of toner distribution in a plurality of areas.
FIG. 18 is a diagram showing an example of the toner image formed in the case where a sheet is delayed.

FIG. 17 is a diagram showing an example of toner distribution in a plurality of areas. Referring to FIG. 17, a toner occupancy ratio and a maximum value of toner density for each of yellow (Y), magenta (M), cyan (C) and black (K) are indicated for each of the eleven areas shown in FIG. 16. The toner occupancy ratio is a ratio occupied by a pixel value having one or more values of toner density among pixels included in each of the areas. According to the first modified embodiment, the deleting disabled area is an area where the toner occupancy ratio is equal to or more than 15%, or the maximum density is equal to or more than 200. Here, areas numbered as 3 to 9 correspond to the deleting disabled areas.

FIG. 18 is a diagram showing an example of the toner image formed in the case where a sheet is delayed. Referring to FIG. 18, the images in the areas 3 to 11 are included from a position of 2 mm from a tip of the sheet in the conveyance direction. Therefore, all of the toner images in the deleting disabled areas are formed on the sheet. Further, in an area from a tip of the sheet in the conveyance direction to a position of 2 mm, the toner image with the area number 2 is formed. As to the toner image with the area number 2, the toner occupancy ratio is 5%, the maximum density of black (K) is "10", the maximum density of cyan (C) is "5", and the predetermined threshold value is equal to or less than 20. Therefore, it is possible to reduce the probability of causing an area of the sheet, in which the toner image with the area number 2 is formed, to winding around the fixing roller pair 32.

Second Modified Embodiment

The MFP 100 according to the second modified embodiment is configured to have a grace period determining portion which is changed from the grace period determining portion 63 included in the MFP 100 according to the first modified embodiment. Specifically, an allowable amount of a shift of an image formed on a sheet is classified into a plurality of levels, and a level setting screen for setting a level is prepared in advance. The grace period determining portion 63 displays the level setting screen in the display unit 160A, and determines the grace period which allows a shift of an image to a level that the user has selected according the level setting screen. For example, there may be provided a first level which permits a shift causing the image to be missed, a second level which does not permit a shift causing the image to be missed, and a third level which prohibits a shift of the image.

In the case where the level 1 is selected, the grace period determining portion 63 determines the grace period which is described in the first modified embodiment. Namely, the grace period determining portion 63 determines: as the deleting disabled area an area among the plurality of rectangular areas, in which the toner occupancy ratio is equal to or more than a predetermined threshold value TH1, or the maximum density is equal to or more than a predetermined threshold value TH2; as the grace distance a distance obtained by subtracting an allowable distance from a distance between a tip of the conveyance direction of the sheet and a tip of the conveyance direction of the deleting disabled area; and as the grace period a value obtained by dividing the grace distance by the toner conveyance speed S.

In the case where the level 2 is selected, the grace period determining portion 63 determines as the grace distance a distance obtained by subtracting an allowable distance from a distance between a tip of the conveyance direction of the sheet and a tip of the conveyance direction of the area specified by the image position, and determines as the grace period a value obtained by dividing the grace distance by the toner conveyance speed S.

In the case where the level 3 is selected, the grace period determining portion 63 does not determine the grace period.

It should be noted that, in the level 1, the user may set the threshold value TH1 and the threshold value TH2.

Figure 19:
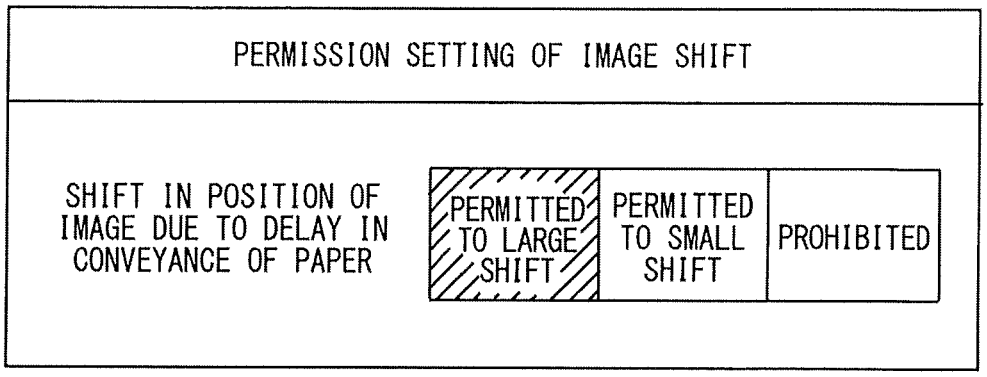
FIG. 19 is a diagram showing an example of a level setting screen.

FIG. 19 is a diagram showing an example of the level setting screen. Referring to FIG. 19, the level setting screen includes: a button indicating the characters "Permitted to Large Shift" thereon; a button indicating the characters "Permitted to Small Shift" thereon; and a button indicating the characters "Prohibited" thereon.

The grace period determining portion 63 selects: the level 1 in the case where the button indicating the characters "Permitted to Large Shift" thereon is designated; the level 2 in the case where the button indicating the characters "Permitted to Small Shift" thereon is designated; and the level 3 in the case where the button indicating the characters "Prohibited" thereon is designated. The grace period determining portion 63 determines the grace period in accordance with a level selected by the user.

Third Modified Embodiment

The MFP 100 according to the third modified embodiment is configured to have a deleting disabled area determining portion which is changed from the deleting disabled area determining portion 59 included in the MFP 100 according to the first modified embodiment.

Figure 20:
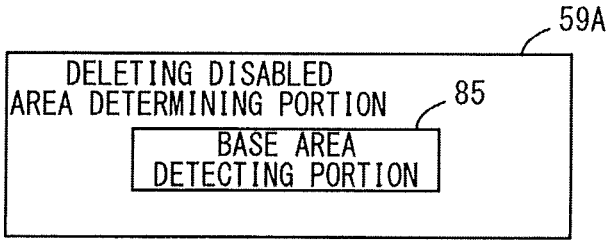
FIG. 20 is a block diagram showing an example of detailed function of the deleting disabled area determining portion according to the third modified embodiment.

FIG. 20 is a block diagram showing an example of detailed function of the deleting disabled area determining portion according to the third modified embodiment. Referring to FIG. 20, the deleting disabled area determining portion 59A according to the third modified embodiment includes a base area detecting portion 85. The base area detecting portion 85 detects a base area. The base area is an area which becomes a background of characters and the like, as well as an area where the pixel value is the same as pixels in the surrounding, or a difference of the pixel value is equal to or less than a predetermined value. For example, the base area detecting portion 85 differentiates the print data by using a differential filter to generate an edge image, and detects as the base area a collection of pixels in which a pixel value of the edge image is equal to "0" or less than a predetermined value. The deleting disabled area determining portion 59A determines an area other than the base area as the deleting disabled area. The deleting disabled area determining portion 59A outputs the print data and the deleting disabled area to the image position determining portion 61.

Since the base area does not include the characters, there are many cases where an information transmitting function is not included. Therefore, possibility of disallowing transmission of information is low even though an image in the base area is not formed on the sheet.

Fourth Modified Embodiment

The MFP 100 according to the fourth modified embodiment includes the conveyance restart portion 75 which outputs a reforming instruction to the image forming control portion 57 and prevents the timing roller 31 from driving even though the paper detection signal is input from the waiting position detecting portion 73 after the restart time, in response to an even that the timing roller 31 becomes able to convey a sheet after the following cases: a case where the grace period has been input from the grace period determining portion 63 and the timing roller 31 does not become able to convey a sheet before the grace period elapses from the restart time; and a case where the grace period has not been input from the grace period determining portion 63 and the timing roller 31 does not become able to convey a sheet until the restart time.

In this case, in response to an event that the reforming instruction is input from the conveyance control portion 67, the image forming control portion 57 controls to cause the image forming units 20Y, 20M, 20C and 20K, and the driving roller 33C to form onto the intermediate transfer belt 30 the same toner image as the previously formed toner image based on the print data which has been input from the print data generating portion 51, and then the image forming control portion 57 conveys the toner image to the transfer position X. The image forming control portion 57 outputs to the conveyance control portion 67 a new exposure start time (a first point of time) when the image forming unit 20Y starts forming the toner image.

Further, in the case where the new exposure start time (the first point of time) is input from the image forming control portion 57 after the reforming instruction is output to the image forming control portion 57, the conveyance restart portion 75 determines a new restart time (a second point of time) when the adjusting period T3 elapses from the exposure start time. Then, in the case where the paper detection signal is input from the waiting position detecting portion 73 before the restart time, the conveyance restart portion 75, when the restart time comes, drives the timing roller 31 to restart conveyance of the sheet. Thus, the sheet is conveyed to the transfer position X, and the toner image is formed at the image position specified by the image formation condition included in the print condition.

As described above, the MFP 100 according to the present embodiments functions as an image processing apparatus capable of: determining the image position indicating a position of an image scheduled to be formed in a sheet; determining the grace period based on the image position; stopping the timing roller 31 on a upstream side from the transfer position X; stopping the sheet at a position (a waiting position) where the timing roller 31 maintains the sheet; and driving to cause the timing roller 31 to restart conveyance of the sheet which has been stopped, at the restart time (the second point of time) when the paper conveyance period T2 elapses from the exposure start time (the first point of time) of starting formation of the toner image onto the photoreceptor drum 23Y. Further, even though conveyance of the sheet cannot be restarted at the restart time, in the case where conveyance of the sheet can be restarted before the grace period elapses from the restart time, the sheet is conveyed to the transfer position X. Therefore, even though conveyance of the sheet cannot be restarted at the restart time, in the case where conveyance of the sheet can be restarted before the grace period elapses from the restart time, since the sheet is conveyed to the transfer position X, the toner image is transferred at a position on the sheet different from the image position though conveyance of the sheet is delayed to reach the transfer position X. Further, since conveyance of the sheet is delayed to reach the transfer position X within the grace period determined based on the image position, the image scheduled to be formed on the sheet can be formed on the sheet. Therefore, even in the case where the sheet is delayed, it is possible to prevent wasteful consumption of toner and extension of the image forming period.

Further, since the grace period is determined from a period obtained by dividing by the toner conveyance speed S a distance obtained by subtracting a predetermined allowance distance from a distance between a tip of the sheet on a downstream side and the image position, it is possible to form all of the images scheduled to be formed on the sheet.

Furthermore, in the case where the image formation condition defines the post processing condition, since the processing area is determined and the grace period is determined from a period obtained by dividing by the toner conveyance speed S a distance between a position on a downstream side of the processing area and the image position, it is possible to prevent the image formed on the sheet from being processed.

Furthermore, since the next exposure start time is changed based on the delay period from the restart time until the sheet reaches the waiting position, it is possible to prevent the delayed sheet and the next sheet from being overlapped with each other.

Furthermore, the MFP 100 according to the first modified embodiment divides the image scheduled to be formed on the sheet into a plurality of areas in a direction from a downstream toward an upstream, determines a state of toner scheduled to be formed for each of the plurality of areas, determines as the deleting disabled area an area in which the state of toner is predetermined, among the plurality of areas, and determines the deleting disabled area as the image position. Therefore, since an area in which the state of toner is predetermined, among the plurality of areas, is determined as the image position, it is possible to lengthen the grace period as long as possible.

Furthermore, the MFP 100 according to the second embodiment determines as the deleting disabled area an area other than the base area in which a difference of density of the image scheduled to be formed on the sheet is equal to or less than a predetermined value, and determines the deleting disabled area as the image position. Therefore, it is possible to lengthen the grace period as long as possible.

Although embodiments of the present invention have been described and illustrated in detail, it is clearly understood that the same is by way of illustration and example only and not limitation, the scope of the present invention should be interpreted by the terms of the appended claims.

What is claims is:

1. An image forming apparatus comprising:

a conveyance controller that conveys a sheet along a conveyance path;

an image forming controller that forms a toner image on an image carrying member, and transfers the toner image formed on the image carrying member onto a sheet being conveyed on the conveyance path at a transfer position in the conveyance path; and a hardware-processor, wherein the hardware-processor determines an image position indicating a position in a sheet for an image scheduled to be formed on the sheet, determines a grace period based on the image position, stops the sheet at a waiting position on an upstream side of the transfer position, restarts conveyance of the sheet at a second point of time when a predetermined time period elapses from a first point of time when formation of the toner image on the image carrying member is started, and conveys the sheet to the transfer position if conveyance of the sheet can be restarted before the determined grace period elapses from the second point of time even when conveyance of the sheet cannot be restarted at the second point of time.

2. The image forming apparatus according to claim 1, wherein the hardware-processor determines as the grace period, a time period during which a sheet is conveyed by a distance obtained by subtracting a predetermined distance from a distance to the image position from an edge on a downstream side of the sheet.

3. The image forming apparatus according to claim 1, further comprising a processing mechanism that processes a sheet on which an image has been formed, wherein the hardware-processor determines a processing area targeted for a processing by the processing mechanism, and determines as the grace period, in the case where the processing area is determined, a time period during which a sheet is conveyed only by a distance to tie image position from a position on an upstream side of the processing area.

4. The image forming apparatus according to claim 3, wherein the hardware-processor determines the grace period in the case where a processing by the processing mechanism belongs to a first type, but does not determine the grace period in the case where a processing by the processing mechanism belongs to a second type.

5. The image forming apparatus according to claim 1, further comprising a processing mechanism that processes a sheet on which an image has been formed, wherein the hardware-processor determines a processing area targeted for a processing by the processing mechanism, and does not determine a grace period in the case where the processing area is determined.

6. The image forming apparatus according to claim 1, further comprising an operation accepting portion that accepts an operation by a user, wherein the hardware-processor switches an operation mode to either a normal mode or an efficiency mode in accordance with the accepted operation, and determines the grace period in the case where the operation mode is switched to the efficiency mode, but does not determine the grace period in the case where the operation mode is switched to the normal mode.

7. The image forming apparatus according to claim 1, wherein the hardware-processor changes, based on a delay period from the second point of time until conveyance of the sheet being stopped at the waiting position can be restarted, a point of time when formation of the next toner image on the image carrying member is started.

8. The image forming apparatus according to claim 1, wherein the hardware-processor divides the image scheduled to be formed on a sheet into a plurality of areas in a direction toward upstream from downstream, determines a state of toner scheduled to be formed for each of the plurality of areas, and determines as the image position, an area of a state where a state of toner is predetermined, among the plurality of areas.

9. The image forming apparatus according to claim 1, wherein the hardware-processor determines as the image position an area, an area other than a base area where a difference of density is equal to or less than a predetermined value, from the image scheduled to be formed on a sheet.

10. An image forming method performed by an image forming apparatus capable of forming a toner image on an image carrying member, and transferring the toner image formed on the image carrying member onto a sheet being conveyed on a conveyance path at a transfer position in the conveyance path, the image forming method comprising:

an image position determining step of determining an image position indicating a position in a sheet for an image scheduled to be formed on the sheet;

a grace period determining step of determining a grace period based on the image position; and a conveyance control step of stopping the sheet at a waiting position on an upstream side of the transfer position, and restarting conveyance of the sheet at a second point of time when a predetermined time period elapses from a first point of time when formation of the toner image on the image carrying member is started, wherein the conveyance control step includes a step of conveying the sheet to the transfer position if conveyance of the sheet can be restarted before the determined grace period elapses from the second point of time even when conveyance of the sheet cannot be restarted at the second point of time.

11. The image forming method according to claim 10, wherein the grace period determining step includes a step of determining as the grace period, a time period during which a sheet is conveyed by a distance obtained by subtracting a predetermined distance from a distance to the image position from an edge on a downstream side of the sheet.

12. The image forming method according to claim 10, further comprising a processing area determining step of determining a processing area targeted for a processing by a processing mechanism, wherein the grace period determining step includes a step of determining as the grace period, in the case where the processing area is determined, a time period during which a sheet is conveyed only by a distance to tie image position from a position on an upstream side of the processing area.

13. The image forming method according to claim 10, wherein the grace period determining step includes a step of determining the grace period in the case where a processing by the processing mechanism belongs to a first type, but does not determine the grace period in the case where a processing by the processing mechanism belongs to a second type.

14. The image forming method according to claim 10, further comprising a processing area determining step of determining a processing area targeted for a processing by a processing mechanism, wherein the grace period determining step includes a step of not determining a grace period in the case where the processing area is determined.

15. The image forming method according to claim 10, further comprising a mode switching step of switching an operation mode to either a normal mode or an efficiency mode in accordance with an operation accepted by an operation accepting portion that accepts an operation by a user, wherein the grace period determining step includes a step of determining the grace period in the case where the operation mode is switched to the efficiency mode, but not determining the grace period in the case where the operation mode is switched to the normal mode.

16. The image forming method according to claim 10, further comprising a step of changing, based on a delay period from the second point of time until conveyance of the sheet being stopped at the waiting position can be restarted, a point of time when formation of the next toner image on the image carrying member is started.

17. The image forming method according to claim 10, further comprising:

a dividing step of dividing the image scheduled to be formed on a sheet into a plurality of areas in a direction toward upstream from downstream;

a toner state determining step of determining a state of toner scheduled to be formed for each of the plurality of areas; and a deleting disabled area determining step of determining as a deleting disabled area, an area of a state where a state of toner is predetermined, among the plurality of areas, wherein the image position determining step includes a step of determining the deleting disabled area as the image position.

18. The image forming method according to claim 10, further comprising a deleting disabled area determining step of determining as the deleting disabled area, an area other than a base area where a difference of density is equal to or less than a predetermined value, from the image scheduled to be formed on a sheet.

19. A non-transitory computer-readable recording medium encoded with an image forming program performed by a computer which controls an image forming apparatus capable of forming a toner image on an image carrying member, and transferring the toner image formed on the image carrying member onto a sheet being conveyed on a conveyance path at a transfer position in the conveyance path, wherein the image forming program causes the computer to perform;

determining an image position indicating a position in a sheet for an image scheduled to be formed on the sheet;

determining a grace period based on the image position;

stopping the sheet at a waiting position on an upstream side of the transfer position;

restarting conveyance of the sheet at a second point of time when a predetermined time period elapses from a first point of time when formation of the toner image on the image carrying member is started; and conveying the sheet to the transfer position if conveyance of the sheet can be restarted before the determined grace period elapses from the second point of time even when conveyance of the sheet cannot be restarted at the second point of time.

* * * * *